US007018118B1

(12) United States Patent
Woosley et al.

(10) Patent No.: US 7,018,118 B1
(45) Date of Patent: Mar. 28, 2006

(54) HUB AND DETECTABLE SPOOL

(75) Inventors: Ernest L. Woosley, Greensburg, PA (US); Doug Jackson, Alison, PA (US); John A. Pomfret, East Lyme, CT (US); Richard Crooks, Apollo, PA (US)

(73) Assignee: Sony Chemicals Corporation of America, Mount Pleasant, PA (US)

( * ) Notice: Subject to any disclaimer, the term of this patent is extended or adjusted under 35 U.S.C. 154(b) by 0 days.

(21) Appl. No.: 10/703,929

(22) Filed: Nov. 7, 2003

Related U.S. Application Data

(62) Division of application No. 10/205,532, filed on Jul. 25, 2002.

(51) Int. Cl.
*B65H 75/00* (2006.01)

(52) U.S. Cl. ..... 400/242; 400/249; 242/357; 242/600; 242/613; 242/912; 164/159

(58) Field of Classification Search ..... 400/242, 400/243, 244, 245, 246, 249; 242/357, 600, 242/613, 912; 72/69; 164/159
See application file for complete search history.

(56) References Cited

U.S. PATENT DOCUMENTS 1,994,950 A * 3/1935 Hoffritz ..... 362/23
4,111,378 A 9/1978 Barwick
4,993,659 A 2/1991 Takai et al.
5,138,968 A * 8/1992 Ohike ..... 116/294
5,143,016 A * 9/1992 Fournier ..... 116/332
5,153,625 A 10/1992 Weber
5,234,175 A 8/1993 Pagano
5,326,182 A 7/1994 Hagstrom
5,385,416 A 1/1995 Maekawa et al.
5,393,149 A 2/1995 Lima
5,415,357 A * 5/1995 Smith, Jr. ..... 242/160.1
5,711,572 A * 1/1998 Khan ..... 297/140
5,755,519 A 5/1998 Klinefelter
5,808,284 A 9/1998 Domanik
5,875,983 A 3/1999 Stuckey et al.
5,926,675 A * 7/1999 Miyano et al. ..... 399/262
6,152,625 A 11/2000 Oliverio
6,199,786 B1 3/2001 Lessard et al.
6,227,643 B1 * 5/2001 Purcell et al. ..... 347/19
6,263,170 B1 7/2001 Bortnem
6,386,772 B1 * 5/2002 Klinefelter et al. ..... 400/208

* cited by examiner

*Primary Examiner*—Andrew H. Hirshfeld
*Assistant Examiner*—Dave A. Ghatt
(74) *Attorney, Agent, or Firm*—Brij K. Agarwal; Eckert Seamans Cherin & Mellott, LLC

(57) ABSTRACT

An improved detectable spool for use with a ribbon includes an improved hub which includes a core and an indication member. The indication member is a generally planar metallic member that is substantially embedded in or is otherwise mounted to the core, with the indication member including a support and a plurality of tabs. In at least one embodiment the indication member is a monolithically formed single-piece member, while in another embodiment the indication member is a multi-component member.

24 Claims, 20 Drawing Sheets

HUB AND DETECTABLE SPOOL

CROSS-REFERENCE TO RELATED APPLICATION

This application is a divisional application of commonly assigned U.S. patent application Ser. No. 10/205,532, filed Jul. 25, 2002 and entitled "HUB AND DETECTABLE SPOOL", and is related to commonly assigned U.S. patent application Ser. No. 10/078,639 filed Feb. 19, 2002, and entitled "DETECTABLE SPOOL AND ASSOCIATED HUB", the disclosures of which are incorporated herein by reference.

BACKGROUND OF THE INVENTION

1. Field of the Invention

The present invention relates generally to printer ribbons and, more particularly, to a detectable spool including indicia that indicate properties of a length of ribbon wound on the detectable spool.

2. Description of the Related Art

Thermal transfer printing equipment is generally known in the relevant art. One type of known thermal transfer process involves the application with a thermal print head of an elevated temperature to regions of a thermal transfer ribbon, with resultant melting of an ink compound of the ribbon at the aforementioned regions. The molten ink compound becomes transferred onto a substrate, which thereby imprints the ink compound onto the substrate. Each ribbon typically is divided into a plurality of consecutively positioned panels, with each panel being usable only for a single printing operation.

Depending upon the type of printing being performed, it may be desirable to have different types of panels provided on the same ribbon. For instance, when it is desired to perform color printing, a given ribbon may consecutively include separate panels containing ink compounds that are colored yellow, magenta, and cyan. A color image that is desired to be printed onto a substrate may be broken up into component images of yellow, magenta, and cyan light. A single color printing operation thus may include three consecutive printing operations, one involving yellow ink, one involving magenta ink, and one involving cyan ink. An appropriately configured color thermal transfer ribbon thus might include consecutive yellow, magenta, and cyan panels repetitively from the beginning of the ribbon to the end of the ribbon. Such a ribbon might bear a designation such as YMC to designate the yellow/magenta/cyan repetitive pattern.

It may additionally be desirable for each series of color panels on the ribbon to be followed by a black panel if it is desired that black printing be provided along with color printing. Such a black panel may be designated by the letter K in the ribbon designation. It may further be desirable to provide an overlay panel on the ribbon which can be used to apply a scratch-resistant overlay surface to the substrate after color and/or black imprintation has occurred. Such an overlay panel may be designated by the letter O in the ribbon designation. It can be seen, therefore, that a thermal transfer ribbon having repetitive series of yellow, magenta, cyan, black, and overlay panels would bear the designation YMCKO. It similarly can be seen that a thermal transfer ribbon having repetitive panels solely of black ink would bear the designation K.

It thus can be seen that numerous different ribbon configurations are possible. It can further be seen that the large number of different ribbon configurations can potentially cause a ribbon having a given panel configuration to be confused by a technician or operator with another ribbon having a different panel configuration. It has thus been deemed desirable to provide some type of indicia on a ribbon spool that will identify to a printer the specific panel configuration of the ribbon wound on the spool. Such a system is the subject of U.S. Pat. No. 5,755,519 to Klinefelter and U.S. Pat. No. 6,152,625 to Oliverio. It is desired, however, to provide an improved detectable spool with identifier indicia that are more reliable, both structurally and operationally, and that can be manufactured less expensively than previously known detectable spools. It is also desired to provide such an improved detectable spool that additionally includes identifier indicia that can visually indicate to an observer the specific panel arrangement of a ribbon.

SUMMARY OF THE INVENTION

Accordingly, an improved detectable spool for use with a ribbon includes an improved hub which includes a core and an indication member. The indication member is a generally planar metallic member that is substantially embedded in or is otherwise mounted to the core, with the indication member including a support and a plurality of tabs. In at least one embodiment the indication member is a monolithically formed single-piece member, while in another embodiment the indication member is a multi-component member.

An aspect of the present invention is to provide an improved hub that includes identifier indicia that indicate to a printer the properties of a ribbon wound on a spool.

Another aspect of the present invention is to provide an improved hub that includes identifier indicia and that is relatively less expensive to manufacture than previously known hubs.

Another aspect of the present invention is to provide an improved hub including identifier indicia that are relatively more reliable in function than previously known hubs.

Another aspect of the present invention is to provide an improved hub including identifier indicia that are relatively easy to manufacture.

Another aspect of the present invention is to provide an improved hub including identifier indicia that not only can be detected by a printer but that can also be visually identified by an observer.

Another aspect of the present invention is to provide an improved hub including a core and an indication member, with the core in certain embodiments being formed to include a surface, and with the indication member in such embodiments being mounted on the surface such as with the use of an adhesive, by molding the material of the core to the indication member, or by other appropriate methods.

Another aspect of the present invention is to provide an improved hub including a core and an indication member, with the core in certain embodiments including a projection, and with the indication member in such embodiments being disposed on the projection. In certain of such embodiments the core may be formed with a surface, and the projection may include an arm and a finger, with the indication member being interposed between the finger and the surface. The projections may be formed by deforming a portion of the core such as by melting a portion of the core with ultrasonic vibration or energy, the use of a heat stake, or other such methodologies, or the projection may be formed in a specially configured mold that forms the projection during initial formation of the core.

Another aspect of the present invention is to provide an improved detectable spool incorporating an improved hub of the type indicated above.

Another aspect of the present invention is to provide an improved indication member that can serve as identifier indicia for a hub of a detectable spool that identifies characteristics of a length of ribbon wound on the detectable spool.

These and other aspects of the present invention are achieved by a hub for use in conjunction with a spool, in which the general nature of the hub can be stated as including a core including a central axis and a surface, the surface being oriented substantially perpendicular to the central axis, the core being structured to be disposed on the spool, an indication member including a support and at least a first tab, the at least first tab being disposed on the support, the indication member being mounted on the core adjacent the surface, and the at least first tab including an elongated dimension that extends in a generally radial direction with respect to the central axis of the core.

Other aspects of the present invention are achieved by a hub for use in conjunction with a spool, in which the general nature of the hub can be stated as including a core including a central axis and a projection, the core being structured to be disposed on the spool, an indication member including a support and at least a first tab, the at least first tab being mounted on the support, the indication member being disposed on the projection, and the at least first tab including an elongated dimension that extends in a generally radial direction with respect to the central axis of the core.

Still other aspects of the present invention are achieved by a method of forming a hub, the hub being usable with a spool, in which the general nature of the method can be stated as including forming a core with a surface, providing an indication member including a support and at least a first tab, disposing the indication member on the surface, and retaining the indication member on the surface.

Other aspects of the present invention are achieved by a method of forming a hub, the hub being usable with a spool, in which the general nature of the method can be stated as including forming a core with a projection, providing an indication member having an aperture formed therein, receiving at least a portion of the projection through the aperture, and deforming at least a portion of the projection to retain the indication member on the core.

Other aspects of the present invention are achieved by a method of forming a hub, the hub being usable with a spool, in which the general nature of the method can be stated as including providing an indication member having an aperture formed therein, molding a moldable material to the indication member, receiving at least a portion of the material through the aperture, and forming the material into a core that retains the indication member thereon.

BRIEF DESCRIPTION OF THE DRAWINGS

A further understanding of the invention can be gained from the following Description of the Preferred Embodiments when read in conjunction with the accompanying drawings in which.

Similar numerals refer to similar parts throughout the specification.

DESCRIPTION OF THE PREFERRED EMBODIMENTS

Figure 1:
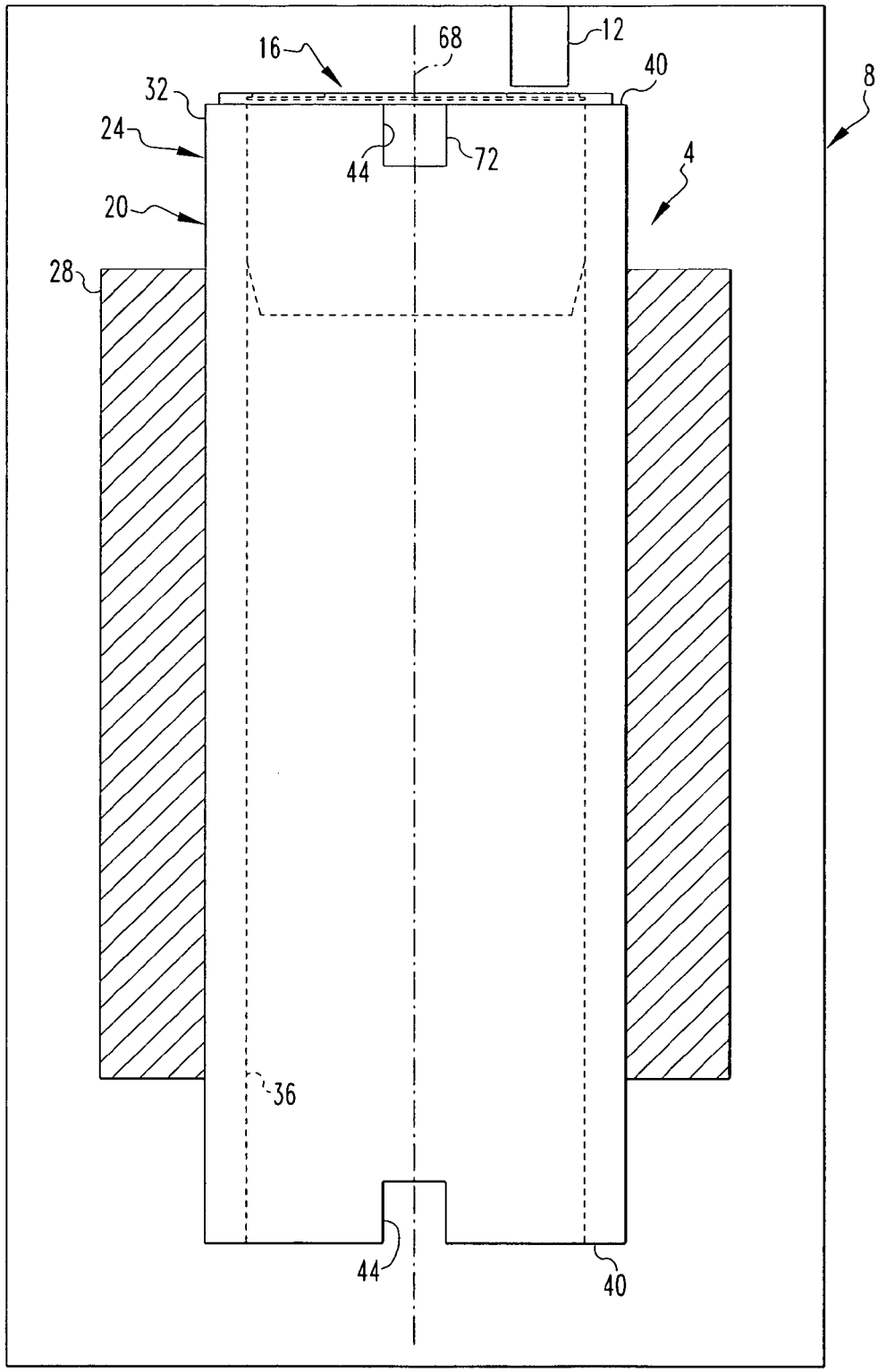
FIG. 1 is an elevational view of a detectable spool in accordance with the present invention disposed within a schematically depicted printer.

A detectable spool 4 in accordance with the present invention is indicated as being disposed within a schematically depicted printer 8 in FIG. 1. The detectable spool 4 is specifically configured to include indicia that indicate to the printer 8 various characteristics of the detectable spool 4. The printer 8 includes a schematically depicted sensor 12, which is part of a sensing apparatus that is configured to detect the indicia included in the detectable spool 4.

As can be understood from FIG. 1, the detectable spool 4 includes a hub 16 in accordance with a first embodiment of the present invention and a ribbon spool 20. The ribbon spool 20 can be generally stated as including a generally hollow cylindrical spool 24 with a length of ribbon 28 being wound on an outer surface 32 of the spool 24. As will be set forth more fully below, the ribbon 28 can be of numerous configurations and may be a dye diffusion thermal transfer ribbon or other type of ribbon. As will be described in greater detail below, the indicia of the detectable spool 4 advantageously can communicate to either or both an observer and the sensor 12 of the printer 8 various characteristics of the ribbon 28.

The spool 24 is formed with a substantially cylindrical thru-bore 36 extending coaxially throughout the longitudinal extent of the spool 24. The spool 24 terminates at a pair of annular ends 40, with each end 40 being formed with a pair of diametrically opposed notches 44. As will be explained in greater detail below, the notches 44 assist in resisting relative rotation between the hub 16 and the spool 24.

Figure 2:
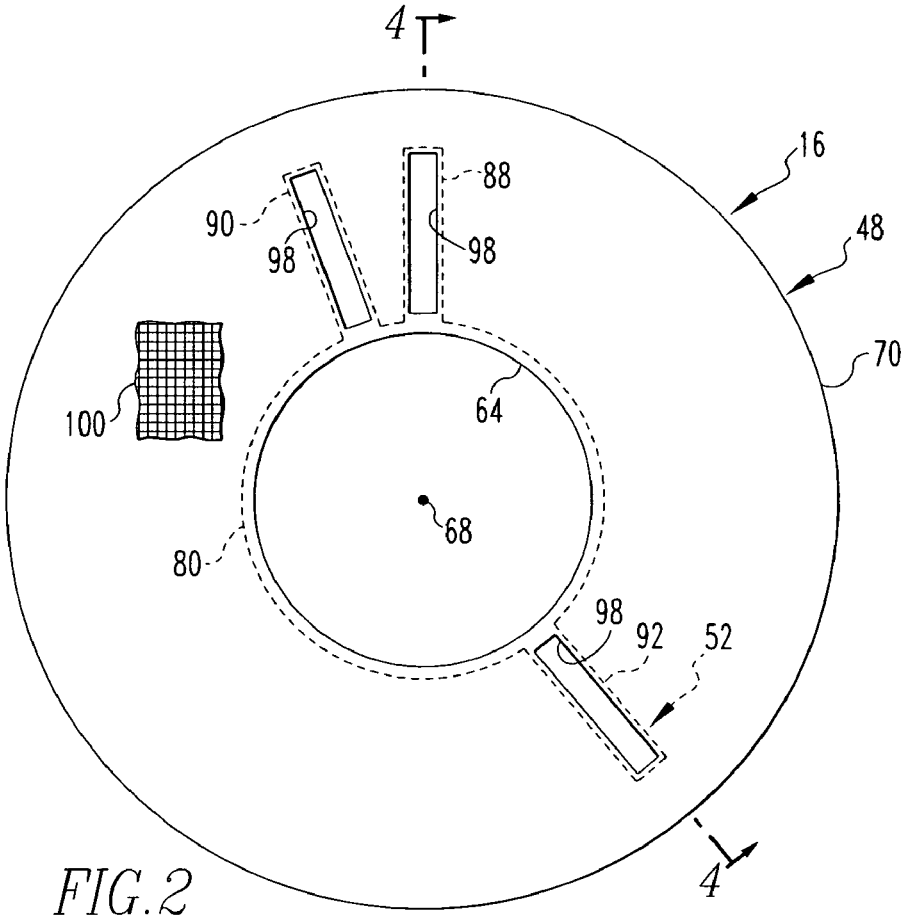
FIG. 2 is a top plan view of an improved hub in accordance with a first embodiment of the present invention.
Figure 3:
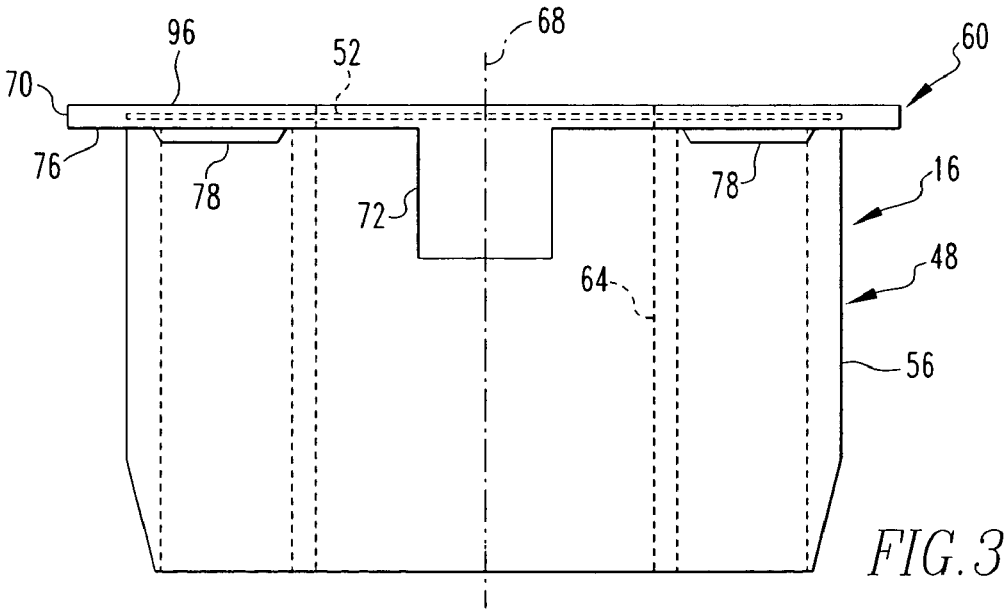
FIG. 3 is an elevational view of the first embodiment.
Figure 4:
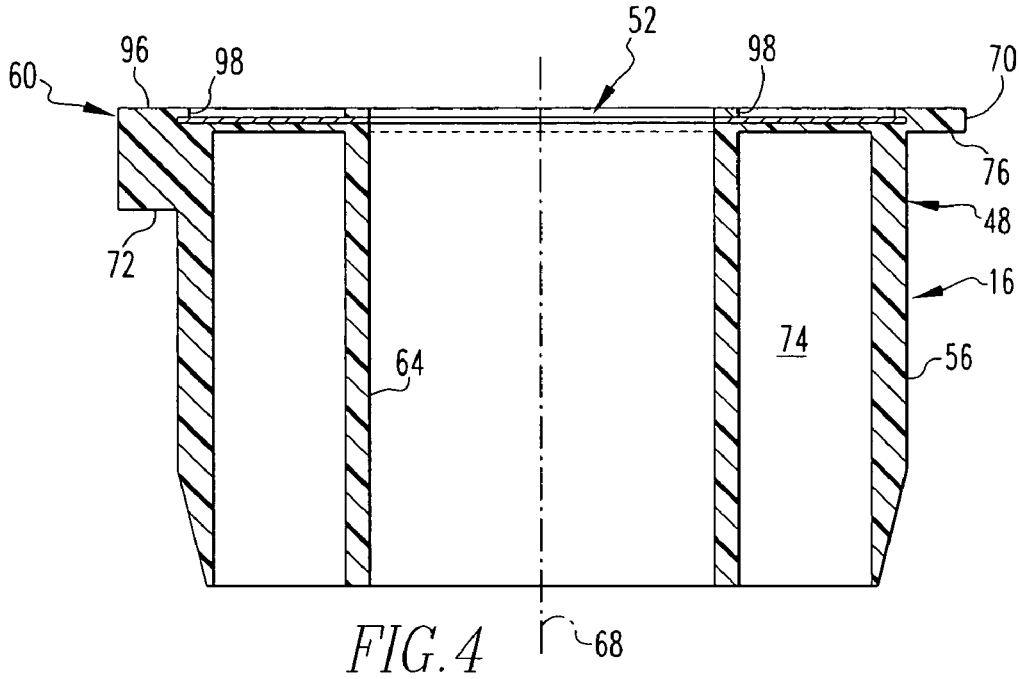
FIG. 4 is a sectional view as taken along line 4—4 of FIG. 2.

The hub 16 is depicted in FIG. 1, and is more particularly depicted in FIGS. 2–4. It can be seen that the hub 16 includes a core 48 and an indication member 52 (FIG. 5), with the indication member 52 being substantially embedded in the core 48. As used herein, the expression "embedded in" and variations thereof shall mean enclosed within or closely surrounded by.

The core 48 may be made of a plastic material that is injection molded, with the indication member 52 being disposed internally within the mold during the molding process. In such a situation, the hub 16 would be manufactured by molding the material of the core 48 about the indication member 52, such that the indication member 52 would be substantially embedded within the core 48.

As is best shown in FIG. 3, the core 48 includes a base 56 and a head 60 connected with one another. As is best shown in FIG. 4, the core 48 is formed with a substantially cylindrical central cavity 64 extending coaxially thetethrough. The core 48 also includes a central axis 68 about which the central cavity 64, the base 56, and the head 60 are axially arranged. The indication member 52 is similarly axially disposed with respect to the central axis 68.

As is shown in FIGS. 3 and 4, the head 60 includes a cylindrical portion 70 and a pair of diametrically opposed ears 72. The cylindrical portion 70 is disposed adjacent the base 56 and is of a greater diameter than the base 56 as measured from the perspective of the central axis 68. The ears 72 are shaped to be complementarily received in the notches 44 when the detectable spool 4 is assembled, as will be discussed in greater detail below.

As can further be seen from FIG. 4, the core 48 is formed with a generally annular void 74 extending substantially through the base 56 and terminating generally at the cylindrical portion 70 of the head 60. The void 74 is provided to reduce the weight of the core 48 as well as to reduce the quantity of materials required to manufacture the core 48.

It can be seen that the part of the cylindrical portion 70 which protrudes outwardly beyond the base 56 defines an annular flange 76 that is disposed against one of the ends 40 of the spool 24 when the detectable spool 4 is assembled. It can be seen that the head 60 additionally includes a plurality of arcuate lugs 78 that each extend along a portion of the flange 76. The lugs 78 can be employed in conjunction with a known ultrasonic welding process or other process for fastening the flange 76, and thus the hub 16, to the spool 24.

Figure 5:
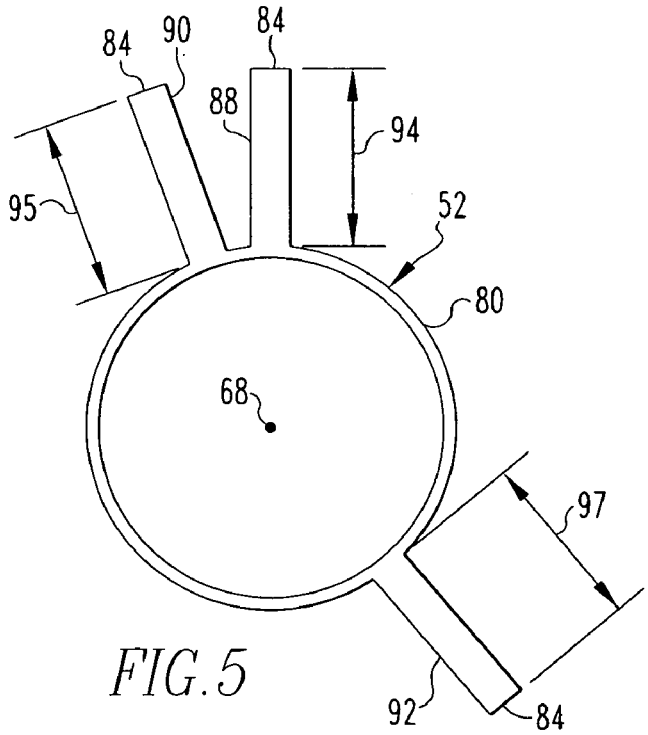
FIG. 5 is a top plan view of an indication member of the first embodiment.

As is best shown in FIG. 5, the indication member 52 includes a ring-shaped support 80 and a plurality of tabs 84. The indication member 52 provides indication means and indicia that can be detected by the sensor 12. The support 80 extends between the tabs 84.

The support 80 and the tabs 84 may be formed out of a sheet of metal or may be formed out of a material that is at least partially metallic or ferromagnetic in character. The support 80 and the tabs 84 are all substantially flat and planar in configuration and may be coplanar with one another.

The indication member 52 may be formed as a single-piece monolithically-formed member that is made from a single piece of material such as a sheet of metal. In such a situation, the indication member 52 may be generally planar in configuration, with the support 80 and the tabs 84 being coplanar with one another, although it is understood that other configurations of the indication member 52 are possible.

As can be understood from FIG. 5, the tabs 84 protrude outwardly from the support 80. More specifically, the tabs 84 protrude perpendicularly away from the support 80, meaning that each tab 84 is oriented substantially perpendicular to a tangent to the support 80 in the vicinity of the respective tab 84.

The tabs 84 include a first home tab 88, a second home tab 90, and a characteristic tab 92. It is understood, however, that reference to "tabs 84" will refer collectively to the first and second home tabs 88 and 90 and the characteristic tab 92. The tabs 84 protrude radially outwardly from the support 80 in a direction generally away from the central axis 68 which, in FIG. 5, protrudes perpendicularly out of the plane of the page of FIG. 5 and is thus indicated by a dot therein. It can be seen that each of the tabs 84 include an elongated dimension indicated by the lines 94, 95, and 97 that extends in a generally radial direction with regard to the central axis 68. In one embodiment of the indication member 52, the inner diameter of the support 80 may be about twelve millimeters in diameter, and the elongated dimensions 94, 95, and 97 of the tabs 84 may have a length of about twelve millimeters. It is understood, however, that the indication member 52, as well as the components thereof, may have dimensions and relative physical proportions different than that depicted herein without departing from the concept of the present invention.

The first and second home tabs 88 and 90 are oriented about 20° apart from one another and together define a "home" position on the indication member 52. The characteristic tab 92 is oriented approximately 140° away from the first home tab 88. The position of the characteristic tab 92 with respect to the "home" position defined by the first and second home tab 88 and 90 corresponds with the characteristics of the ribbon 28 wound on the spool 24. The specific position of the characteristic tab 92 depicted generally in FIG. 5 and described above corresponds with a ribbon 28 that is purely black, meaning that the color designation of the ribbon 28 would be "K". As will be set forth more fully below, a different positioning of the characteristic tab 92 with respect to the first and second home tabs 88 and 90 would correspond with and identify a different ribbon having different characteristics than the ribbon 28.

As can be understood from FIG. 4, the indication member 52 is generally embedded within the cylindrical portion 70 of the head 60 of the core 48. The indication member 52 may be embedded about 0.3 millimeters from a generally planar outer surface 96 of the cylindrical portion 70, although other positions for the indication member 52 may be appropriate depending upon the specific configuration thereof.

As can be understood from FIGS. 2 and 4, a plurality of windows 98 are formed in the cylindrical portion 70 between the indication member 52 and the outer surface 96, with the windows 98 being shaped and oriented to correspond with the tabs 84. The windows 98 thus extend between the tabs 84 and the exterior of the hub 16. The windows 98 are generally provided in order to minimize the quantity of material of the core 48 that is interposed between the tabs 84 and the sensor 12 in order to facilitate detection of the tabs 84 by the sensor 12. The windows 98 may be formed in the core 48 in any of a wide variety of fashions including formation of the windows 98 during initial molding of the core 48. It is understood, however, that depending upon the specific configuration of the indication member 52, the material out of which the core 48 is formed, and the depth below the outer surface 96 to which the indication member 52 is embedded, as well as other factors, the hub 16 may be formed without any windows 98 without detection of the tabs 84 by the sensor 12 being meaningfully impaired.

When the hub 16 is mounted on the ribbon spool 20 to form the detectable spool 4, and when the detectable spool 4 is installed into the printer 8, an appropriate mechanism of the printer 8 rotates the detectable spool 4 about the central axis 68 in order for the relative positions of the tabs 84 to be detected by the sensor 12. Once the printer 8 ascertains the position of the characteristic tab 92 with respect to the "home" position defined by the first and second home tabs 88 and 90, the printer 8 then can determine the specific configuration of the ribbon 28 on the detectable spool 4. In this regard, the printer 8 may then commence operations if the characteristics of the ribbon 28 are appropriate to the printing tasks to be undertaken by the printer 8, or an alarm or other indication message may be transmitted to a technician if the ribbon 28 is incorrect.

The core 48 is advantageously manufactured out of a material having a first color that can be readily identified by an observer such as a technician or other operator. The color of the material out of which the core 48 is manufactured is represented by the hatched region of FIG. 2 designated by the numeral 100. The distinctive color of the material of the core 48 thus permits the detectable spool 4 to be identified by the observer and to enable the detectable spool 4 to be distinguished from other detectable spools that may otherwise be similar in appearance to the detectable spool 4. The color of the material out of which the core 48 is formed thus provides indicia and serves as indication means on the detectable spool 4 as to the specific characteristics of the ribbon 28. It is further understood that in other embodiments (not specifically shown) that the core 48 can bear other types of color identification means such as colored adhesive labels, imprintation or coating of the core 48 with pigments or coatings having a color, colored inserts mounted on or partially in the core 48, and myriad other configurations.

The indication member 52 can be relatively inexpensively manufactured, such as by stamping, and can be readily embedded in the core 48. The relative positions of the tabs 84 with respect to one another is advantageously maintained by the support 80 such that the tabs 84 generally cannot be incorrectly positioned on the core 48. This substantially eliminates the need for quality assurance testing as to the relative positions of the tabs 84 as well as the potential for lost production due to manufacturing error in this regard. Moreover, the potential for one or more of the tabs 84 becoming detached from the hub 16 is substantially eliminated since the tabs 84 are connected together with the support 80. Additionally, by configuring the indication member 52 as a monolithically-formed single-piece member, the indication member 52 can be handled as a single unit, as compared with simultaneously handling a plurality of separate metallic members, which facilitates manufacture of the hub 16. Furthermore, the tabs 84 each provide a relatively large member that can be readily detected by the sensor 12, which facilitates rapid operation of the printer 8 after installation of the detectable spool 4.

The configuration of the indication member 52 and thus the hub 16 permits the detectable spool 4 to be manufactured relatively less expensively and more reliably than previously known devices. The indicia provided by the indication member 52 and by the color of the material out of which the core 48 is formed permit the printer 8 and an observer, respectively, to readily ascertain the specific characteristics of the ribbon 28.

Figure 6:
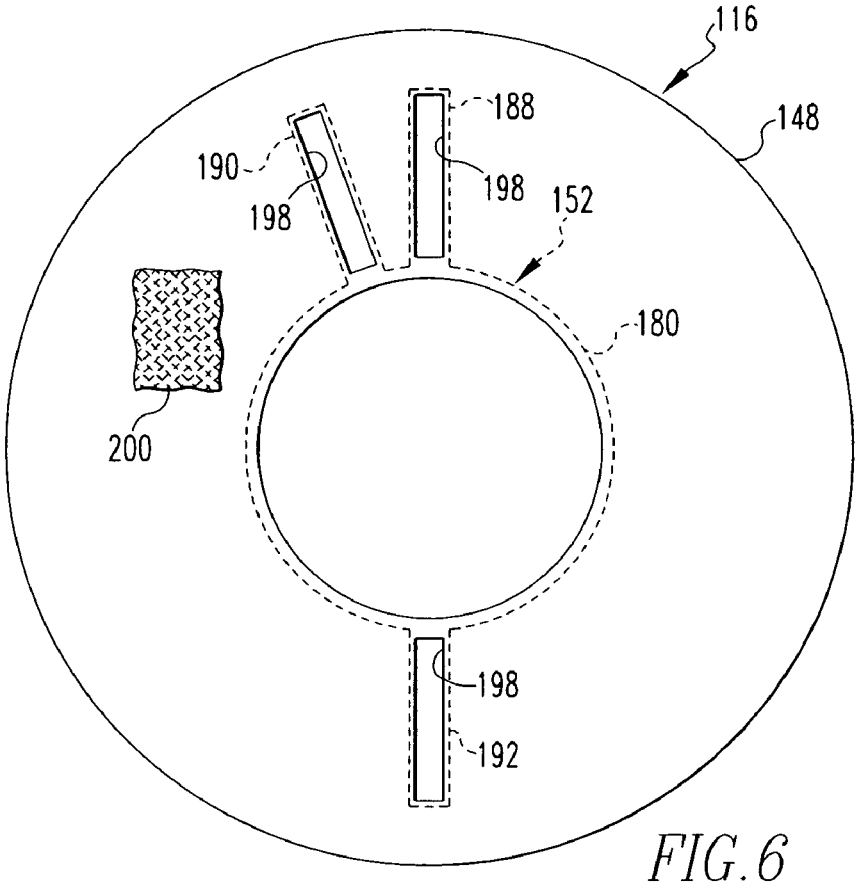
FIG. 6 is a top plan view of an improved hub in accordance with a second embodiment of the present invention.

A hub 116 in accordance with a second embodiment of the present invention is indicated generally in FIG. 6. The hub 116 includes a core 148 and an indication member 152, with the indication member 152 being substantially embedded in the core 148. The indication member 152 is generally similar to the indication member 52, except the indication member 152 is configured for a ribbon having different characteristics than the ribbon 28.

Figure 7:
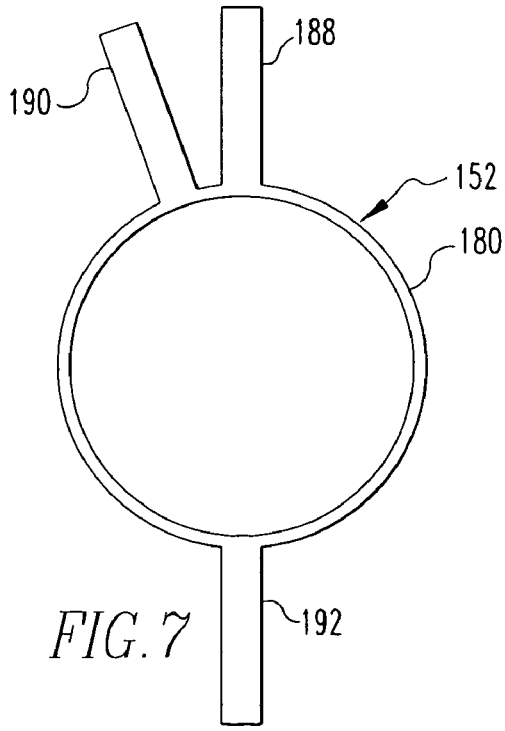
FIG. 7 is a top plan view of an indication member of the second embodiment.

It can be seen from FIG. 7 that the indication member 152 includes a generally ring-shaped support 180, along with a first home tab 188, a second home tab 190, and a characteristic tab 192. While the first and second home tabs 188 and 190 are oriented about 20° apart from one another and together define a "home" position for the indication member 152, the characteristic tab 192 is oriented about 160° apart from the second home tab 190. It can be seen that the windows 198 formed in the core 148 correspond with the specific positions of the first and second home tabs 188 and 190 and the characteristic tab 192, and thus are positioned differently than the windows 98 of the core 48. Since the characteristic tab 192 is disposed at a different position with respect to the "home" position than was the characteristic tab 92, the sensor 12 of the printer 8 will detect that the ribbon used in association with the hub 116 is different than the ribbon 28 which is used in association with the hub 16.

The core 148 is formed of a material having a color that is different than the color of the material out of which the core 48 is manufactured. The color of the material out of which the core 148 is manufactured is represented by the hatched region of FIG. 6 designated by the numeral 200. By observing the specific color of the material out of which the core 148 is formed, an observer such as a technician can readily ascertain the characteristics of the ribbon used in association with the hub 116. Moreover, by noting the color of the material out of which the core 148 is made, the observer can readily ascertain that the ribbon used in association with the hub 116 is different than the ribbon 28 used in association with the hub 16. The indication member 152 and the color of the material out of which the core 148 is manufactured thus each serve as indicia and as indication means which permit the printer 8 and an observer, respectively, to readily ascertain the characteristics of the ribbon with which the hub 116 is employed.

Figure 8:
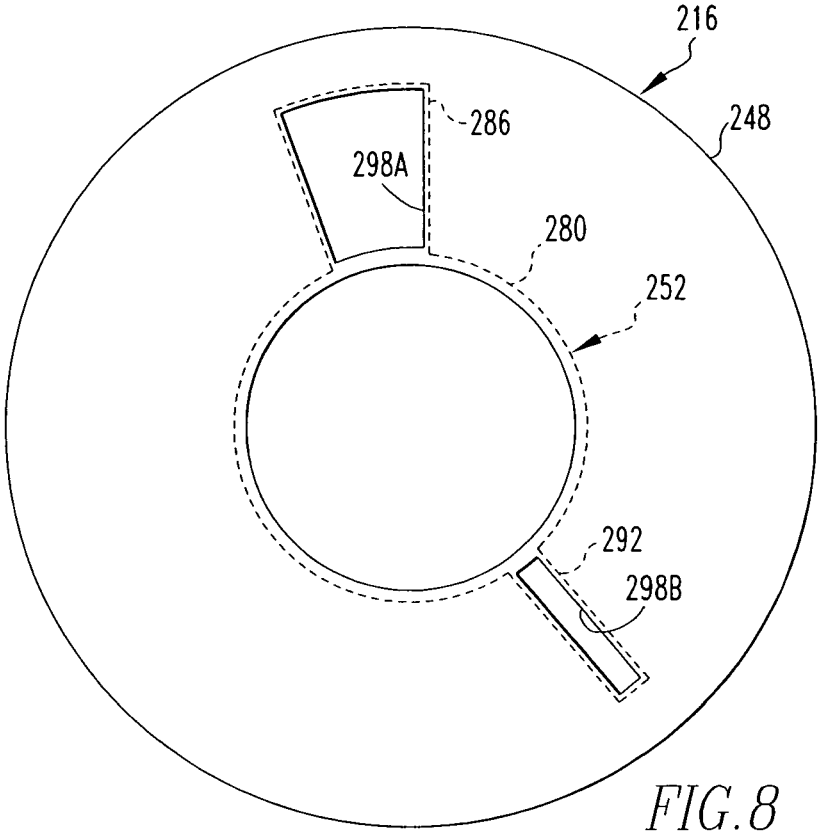
FIG. 8 is a top plan view of an improved hub in accordance with a third embodiment of the present invention.
Figure 9:
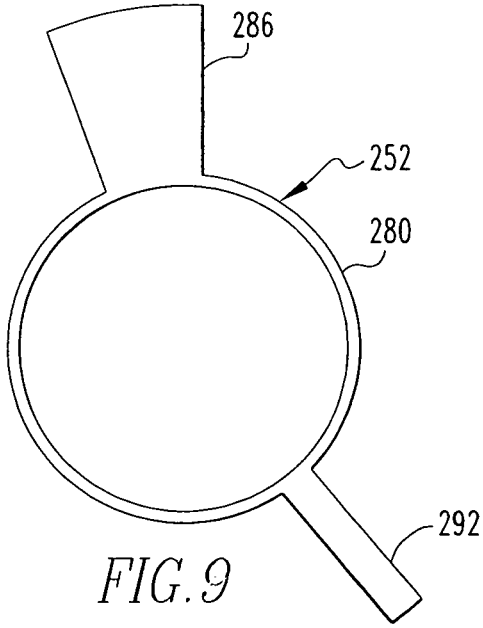
FIG. 9 is a top plan view of an indication member of the third embodiment.

A hub 216 in accordance with a third embodiment of the present invention is indicated generally in FIG. 8. The hub 216 includes a core 248 and an indication member 252 (FIG. 9), with the indication member 252 being substantially embedded in the core 248. As can be seen in FIG. 9, the indication member 252 includes a ring-shaped support 280, a composite home tab 286, and a characteristic tab 292. The indication member 252 is similar to the indication member 52, except that the composite home tab 286 takes the place of the first and second home tabs 90 and 92. The composite home tab 286 potentially can be less expensive to manufacture than the separate first and second home tabs 88 and 90, and additionally may be more reliably detected by the sensor 12 of the printer 8.

It can be seen from FIG. 8 that the hub 216 is formed with a relatively large window 298A disposed over the composite home tab 286 and a relatively smaller window 298B disposed over the characteristic tab 292. The windows 298A and 298B permit the sensor 12 to detect the presence and relative orientations of the composite home tab 286 and the characteristic tab 292 in the manner set forth above.

Figure 10:
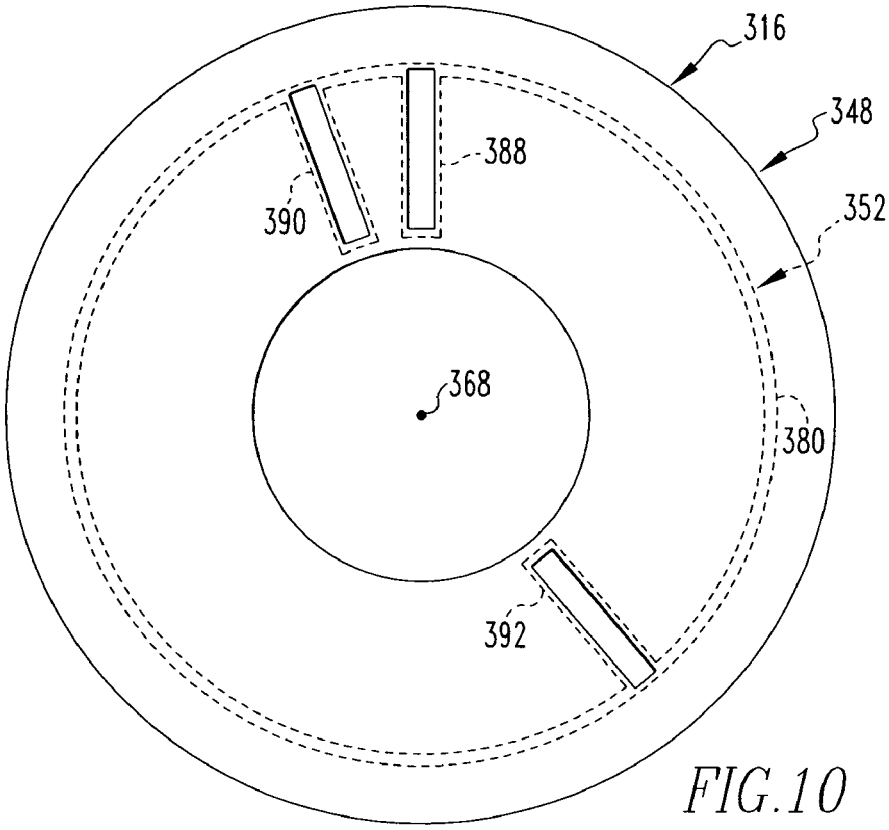
FIG. 10 is a top plan view of an improved hub in accordance with a fourth embodiment of the present invention.

A hub 316 in accordance with a fourth embodiment of the present invention is indicated generally in FIG. 10. The hub 316 includes a core 348 and an indication member 352, with the indication member 352 being substantially embedded in the core 348.

Figure 11:
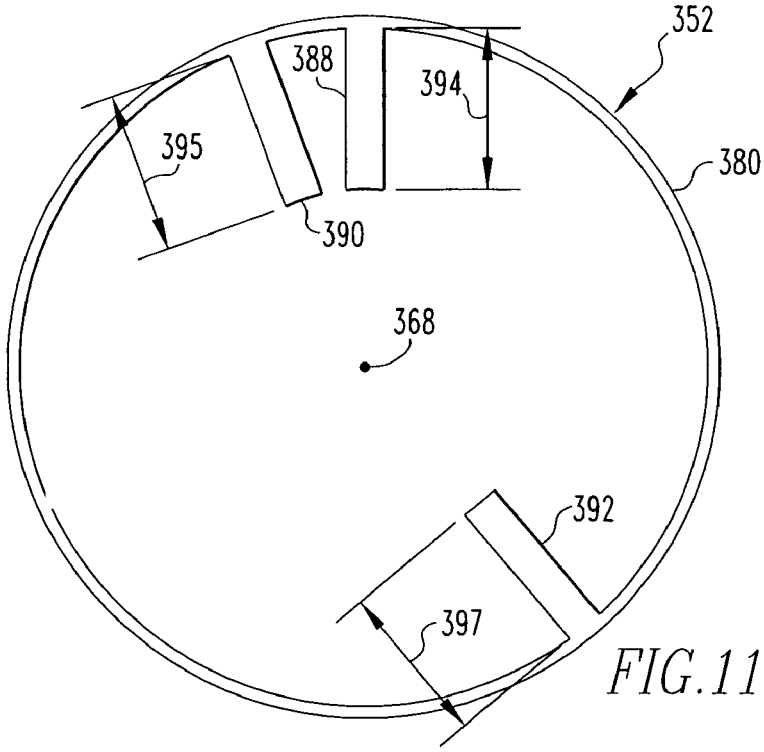
FIG. 11 is a top plan view of an indication member in accordance with the fourth embodiment.

It can be seen from FIG. 11 that the indication member 352 includes a ring-shaped support 380, along with a first home tab 388, a second home tab 390, and a characteristic tab 392. The first and second home tabs 388 and 390 and the characteristic tab 392 are disposed in the same relative positions as the tabs 84 of the hub 16. It can be seen, however, that the support 380 is larger than the support 80, and that the first and second home tabs 388 and 390 and the characteristic tab 392 each include an elongated dimension indicated by the lines 394, 395, 397 that extends in a generally radial direction from the support 380 toward the central axis 368, which is indicated by a dot in FIG. 11. Other than the different configuration of the indication member 352, the hub 316 is substantially similar to the hub 16.

Figure 12:
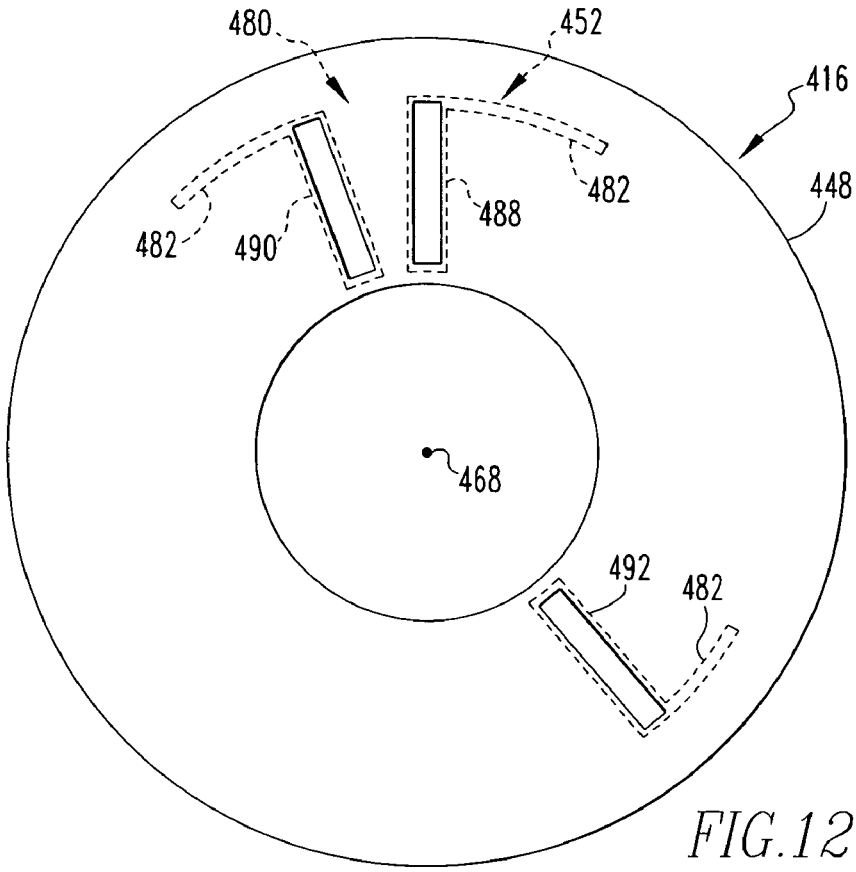
FIG. 12 is a top plan view of an improved hub in accordance with a fifth embodiment of the present invention.
Figure 13:
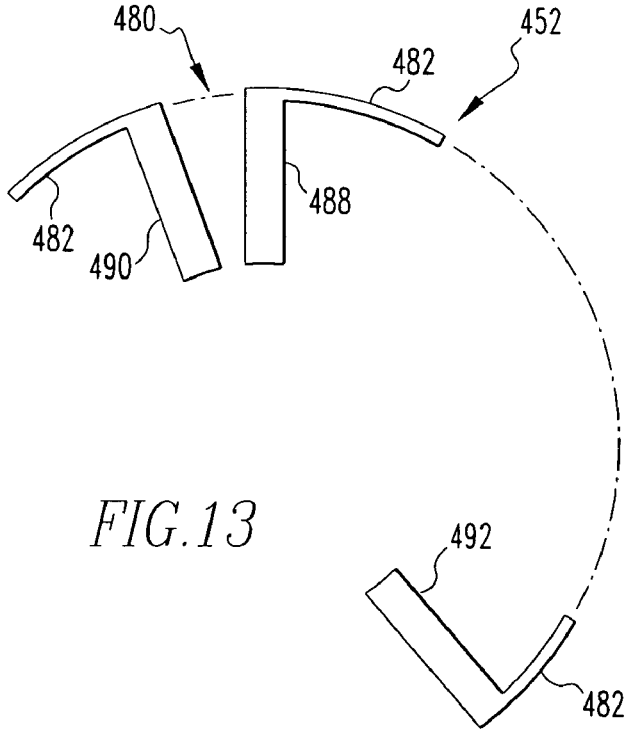
FIG. 13 is a top plan view of an indication member in accordance with the fifth embodiment.

A hub 416 in accordance with a fifth embodiment of the present invention is indicated generally in FIG. 12. The hub 416 includes a core 448 and an indication member 452 (FIG. 13), with the indication member 452 being substantially embedded in the core 448.

The indication member 452 is substantially similar to the indication member 352 in that it includes a support 480, a first home tab 488, a second home tab 490, and a characteristic tab 492, with the first and second home tabs 488 and 490 and the characteristic tab 492 extending from the support 480 toward the central axis 468. The support 480 is, however, made up of a plurality of arcuate support portions 482 that are separated from one another. The first home tab 488 is disposed on one of the support portions 482, the second home tab 490 is disposed on another support portion 482, and the characteristic tab 492 is disposed on yet another support portion 482.

The first and second home tabs 488 and 490 and the characteristic tab 492 are disposed in substantially the same positions as the first and second home tabs 388 and 390 and the characteristic tab 392. By separating the support 480 into the plurality of support portions 482, the support 480 causes relatively less interference when the sensor 12 is seeking to detect the presence of the first and second home tabs 488 and 490 and the characteristic tab 492. As such, the specific configuration of the indication member 452 can be detected by the sensor 12 relatively more readily than the indication member 352 can be detected. The hub 416 is otherwise substantially similar to the hub 16.

Figure 14:
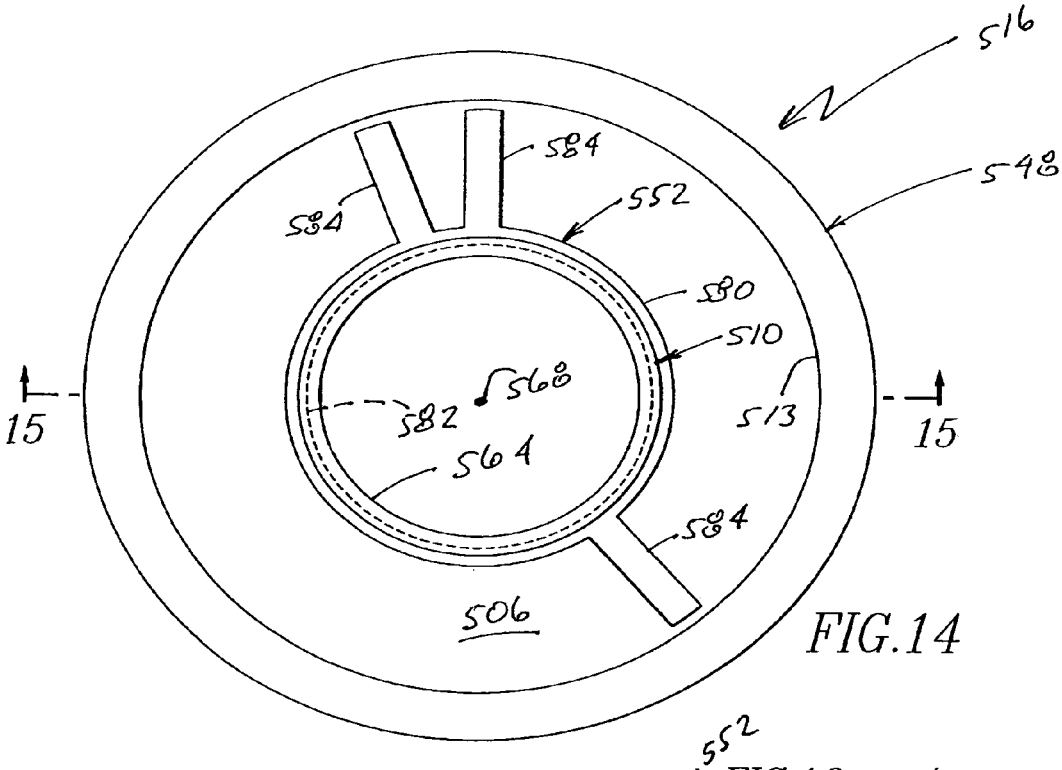
FIG. 14 is a top plan view of an improved hub in accordance with a sixth embodiment of the present invention.

A hub 516 in accordance with a sixth embodiment of the present invention is indicated generally in FIG. 14. The hub 516 includes a core 548 and an indication member 552, with the indication member 552 including an annular support 580 and a plurality of tabs 584. The annular shape of the support 580 defines a substantially circular central void 582. It can be seen, therefore, that the indication member 552 can be generally stated as including a ring-shaped component, i.e., the support 580, as well as a plurality of radially extending elongated tab members, i.e., the tabs 584.

The core 548 includes a surface 506 that is substantially planar and annular and is oriented substantially perpendicular to a central axis 568 of the core 548. The core 548 additionally includes a projection 510 that extends outwardly from the surface 506 and that is generally annular in cross-section. It can be understood from FIGS. 14–16 that the projection 510 is disposed substantially adjacent a central cavity 564 of the core 548. The core 548 further includes a ridge 513 that extends outwardly from the surface 506 and that is disposed near the periphery of the core 548, i.e., the ridge 513 is spaced from the central cavity 564. Accordingly, it can be seen that the surface 506 is defined generally between the projection 510 and the ridge 513, and thus is substantially annular in shape.

Figure 15:
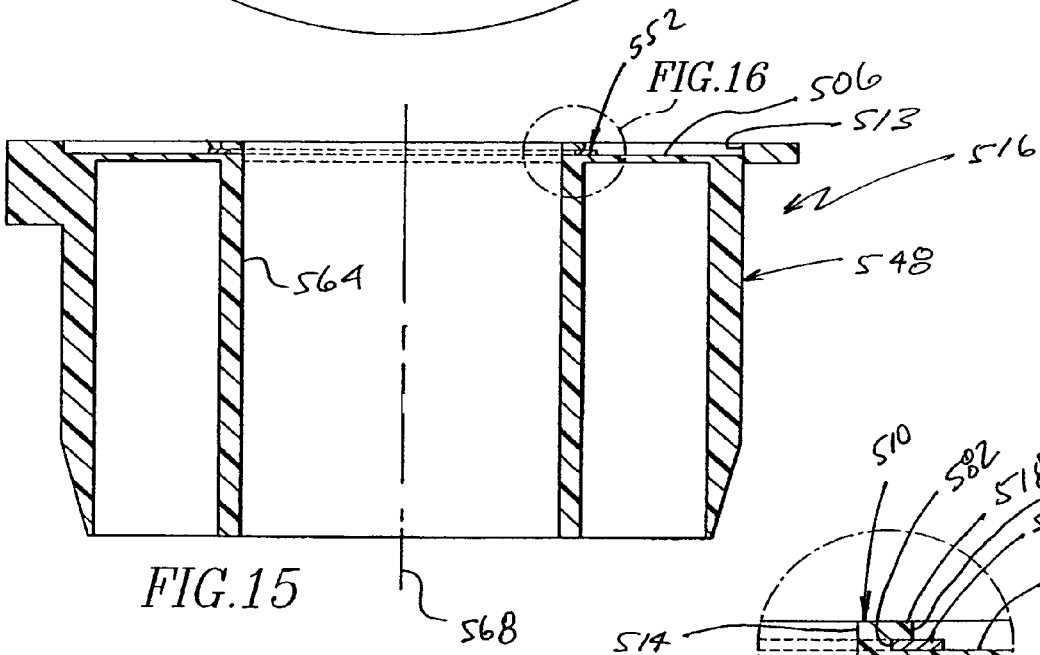
FIG. 15 is a sectional view as taken along line 15—15 of FIG. 14.
Figure 16:
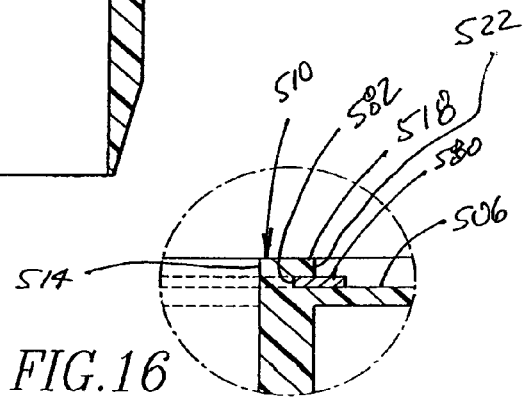
FIG. 16 is an enlarged view of a portion of FIG. 15.

As is best shown in FIG. 16, the projection 510 includes an arm 514 that extends outwardly from the surface 506, and further includes a finger 518 that extends outwardly from the arm 514 and is disposed substantially at a free end 522 of the projection 510. As can be understood from FIGS. 15 and 16, the support 580 is interposed between the finger 518 and the surface 506, whereby the projection 510 retains the indication member 552 on the surface 506. It can also be seen that the core 548, including the projection 510, extends around at least a portion of the indication member 552.

The indication member 552 lies on the surface 506 generally between the arm 514 and the ridge 513, and at least a portion of the indication member 552, specifically the support 580, is interposed substantially between the finger 518 and the surface 506. The finger 518 is depicted in the accompanying drawings as extending across a portion of the support 580 but not extending across the entire radial extent thereof. It is understood that in other embodiments the finger 518 could extend across the entirety of the support 580 without departing from the concept of the present invention.

The tabs 584 are depicted as extending along a substantial portion of the radial extent of the surface 506 and stopping a short distance from the ridge 513. It is understood that in other embodiments the tabs 584 may extend along a greater or lesser portion of the radial extent of the surface 506 without departing from the concept of the present invention, and even may extend fully into engagement with the ridge 513.

It can be seen from FIG. 16 that the surface 506 is defined on a recessed region of the core 548 between the projection 510 and the ridge 513, and that the indication member 552 is received in such recessed region. It can further be seen that the hub 516 is different from the hubs of the embodiments set forth above in that the tabs 584 are substantially exposed in their entireties meaning that none of the material of the core 548 is disposed in the annular sectors between adjacent tabs 548. Accordingly, the ridge 513 protects the tabs 584 from being caught on other structures, such as a technician's clothing, the components of the printer 8 into which the hub is received, the packing materials within which the hub 516 is shipped and/or stored, or other such structures. The ridge 513 thus serves to maintain the integrity of the hub 516, and the indication member 552 in particular, from damage during the process of installing the hub 516 into the printer 8. The addition of the ridge 513 may also serve to simplify some of the operations involved in forming the core 548 and/or the hub 516. It is understood, however, that in other embodiments (not shown) of the hub of the present invention the ridge 513 may be absent depending upon the specific needs of the particular application.

In one example of the indication member 552, the inner diameter of the support 580 is approximately 0.540 inches, and the outer diameter of the support 580 is approximately 0.600 inches. The tabs 584 of such an exemplary indication member 552 are approximately 0.062 inches wide and are approximately 0.167 inches in length as measured between the outer diameter of the support 580 and the free end of the tab 584. The thickness of the exemplary indication member 552 is approximately 0.020 inches, and the exemplary indication member 552 is manufactured out of AISI 1018 carbon steel, although other dimensions and materials may be appropriate depending upon the specific needs of the particular application. An exemplary core 548 that may be employed in conjunction with the aforementioned exemplary indication member 552 may include a ridge 513 that is 0.939 inches in diameter and approximately 0.022 inches in height as measured between the surface 506 and the longitudinal extremity of the ridge 513. Dimensions varying from those set forth above may be appropriate depending upon the specific needs of the particular application.

Figure 17:
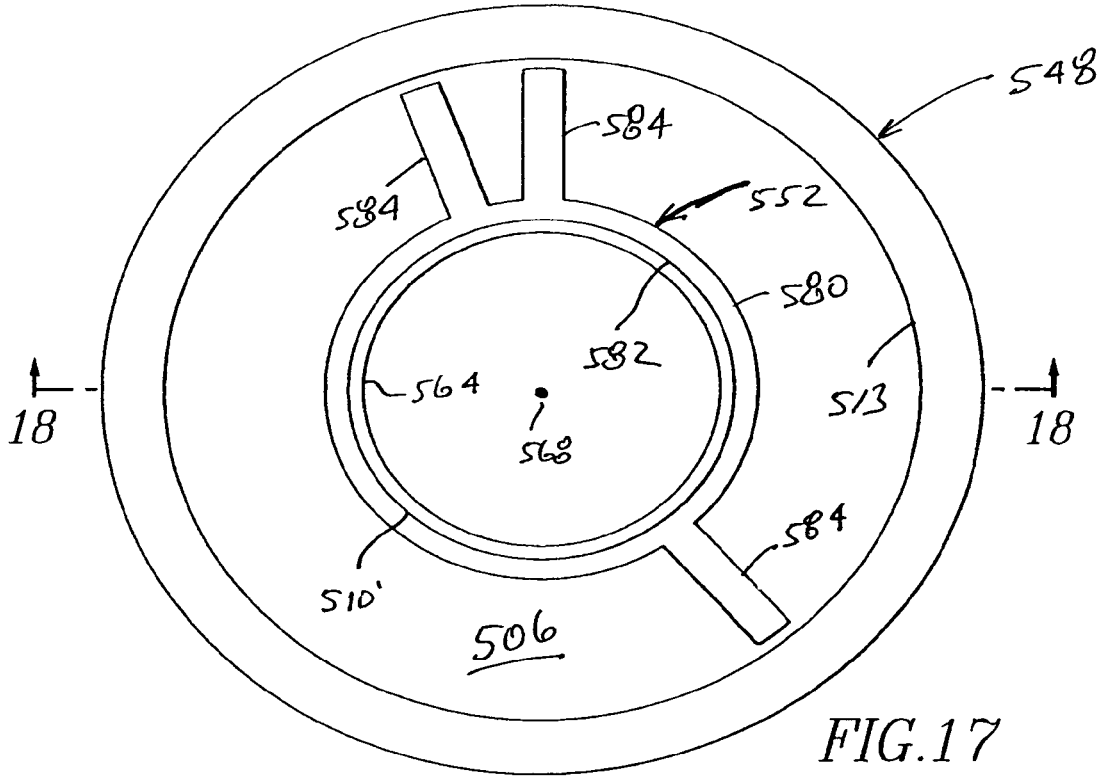
FIG. 17 is an operational top plan view during formation of the sixth embodiment according to a method.
Figure 18:
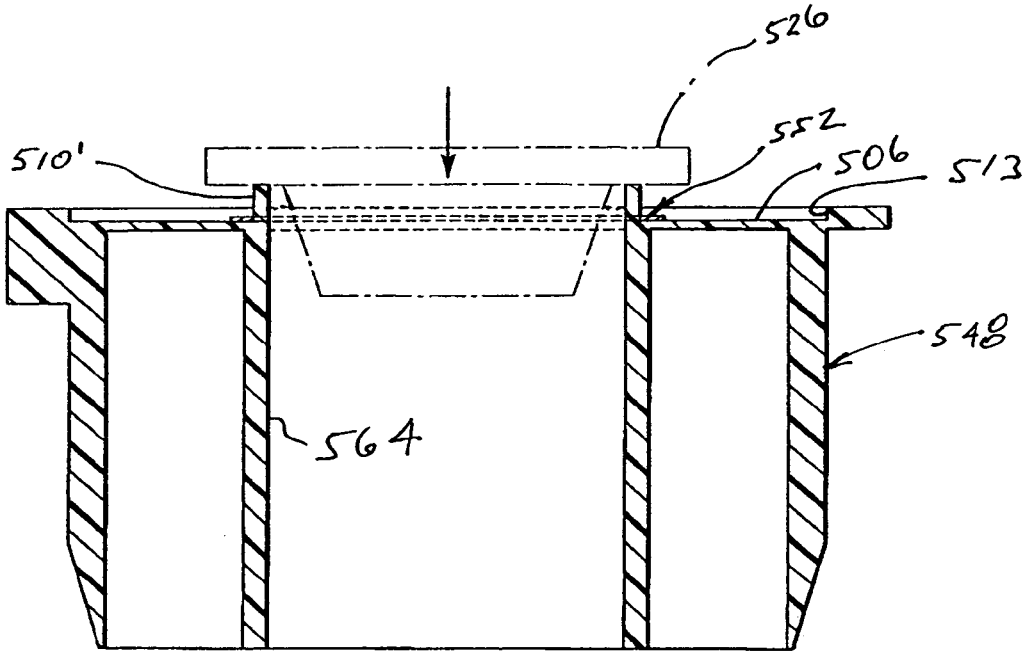
FIG. 18 is a sectional view as taken along line 18—18 of FIG. 17 and additionally depicting a tool that may be employed in forming the sixth embodiment according to the method.

The hub 516 can be manufactured in any of a wide variety of fashions. One such method is depicted generally in FIGS. 17 and 18. Specifically, the core 548 can be formed with a projection 510' that is of a substantially fixed cross-section and that extends outwardly from the surface 506. The indication member 552 is then positioned on the core 548, with the projection 510' being received through the central void 582. A tool 526 (FIG. 18) is then applied to the projection 510' to deform the projection 510' until it forms the projection 510 as is depicted in FIGS. 14–16 over the annular support 580. If the core 548 is manufactured of a thermoplastic material, the tool 526 can deform the projection 510' by melting at least a portion of it. For such purpose, the tool 526 can be a heat stake that operates at an elevated temperature or alternatively can be an ultrasonic vibration head that ultrasonically vibrates the projection 510' to the point of melting. It is understood that other deformation methodologies and heating methodologies may be employed without departing from the concept of the present invention. The amount of deformation of the projection 510' may be controlled so that the thermoplastic material of the core 548 will overlie a sufficient radial extent of the annular support 580, or even possibly completely overlie the annular support 580, in order to securely hold the indication member 552 in place on the core 548.

Another method of manufacturing the hub 516 would be to position the indication member 552 in an appropriate mold (not shown) and then to pour an appropriate material such as a melted thermoplastic material into the mold to form the core 548. In this regard, the method preferably would form the core 548 around at least a portion of the indication member 552 in the configuration depicted generally in FIGS. 14–16, whereby at least a portion of the core 548 would extend around or would be molded around at least a portion of the indication member 552. In particular, it is preferred that at least a portion of the projection 510 is formed to extend around or be molded around at least a portion of the annular support 580, thereby leaving the plurality of tabs 584 completely exposed. It is further understood, however, that still other methodologies may be employed to form the hub 516. Regardless of the specific method of manufacture, it can be seen that the central void 582 serves as an aperture that can receive at least a portion of the projection 510 therethrough.

Figure 19:
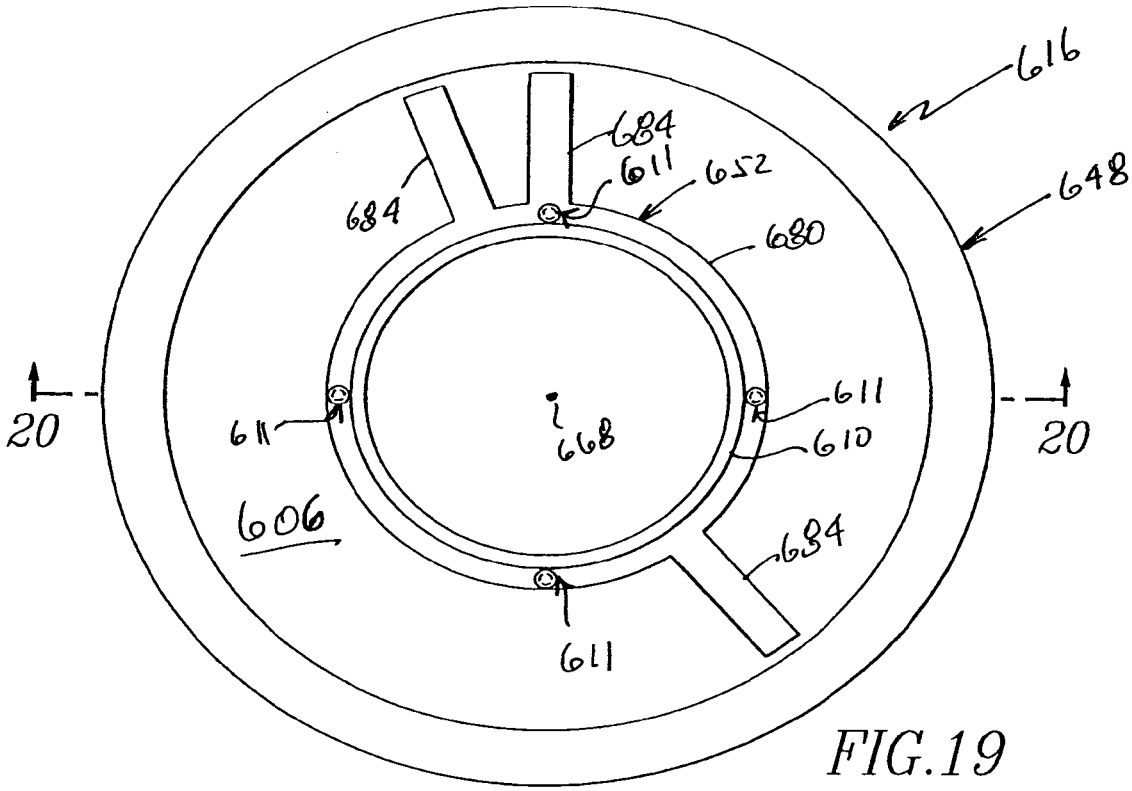
FIG. 19 is a top plan view of an improved hub in accordance with a seventh embodiment of the present invention.
Figure 20:
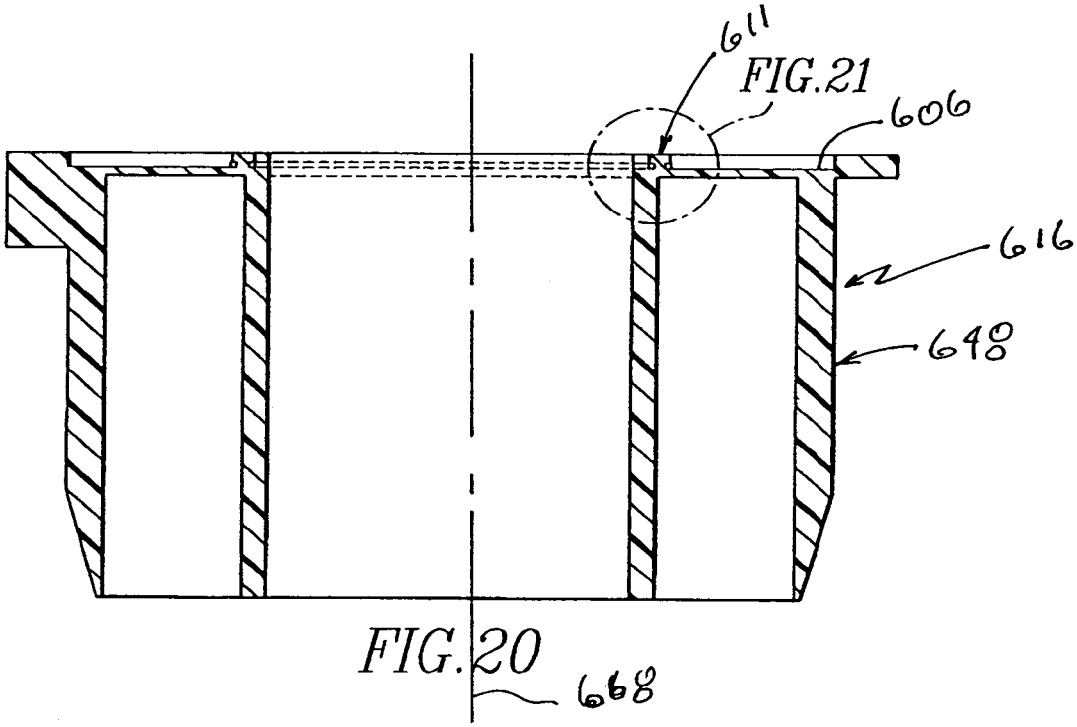
FIG. 20 is a sectional view as taken along line 20—20 of FIG. 19.
Figure 23:
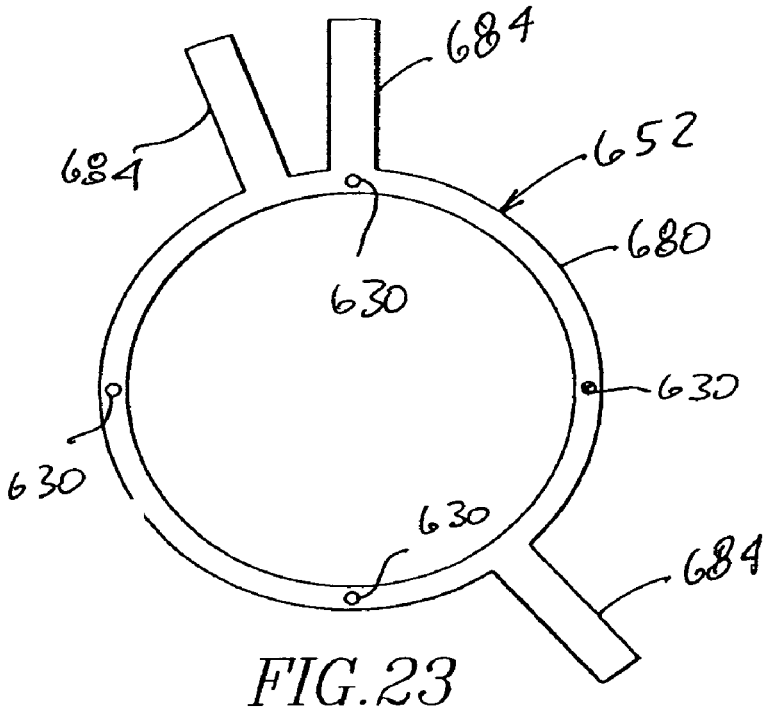
FIG. 23 is a top plan view of an indication member of the seventh embodiment.
Figure 22:
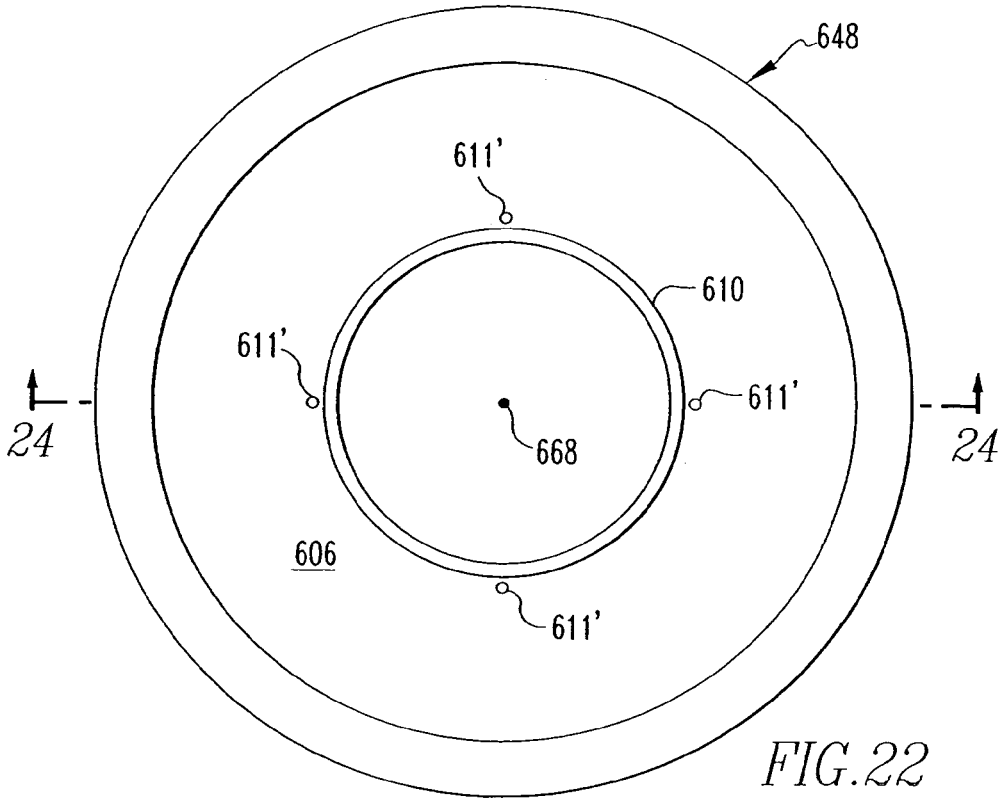
FIG. 22 is a top plan view of a core of the seventh embodiment.
Figure 24:
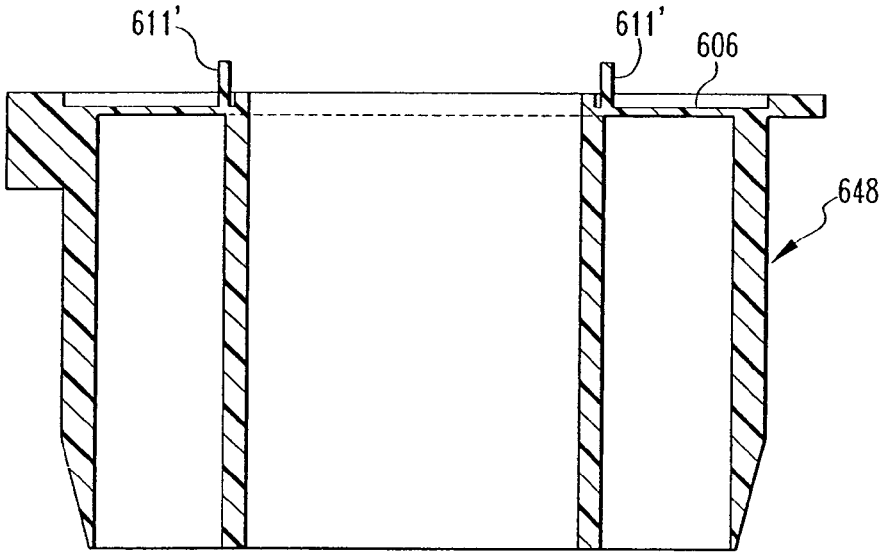
FIG. 24 is a sectional view as taken along line 24—24 of FIG. 22.

A hub 616 in accordance with a seventh embodiment of the present invention is indicated generally in FIG. 19. The hub 616 includes a core 648 (FIG. 22) and an indication member 652 (FIG. 23), with the indication member 652 including an annular support 680 and a plurality of tabs 684. The support 680 includes a plurality of holes 630 formed therein. The indication member 652 therefore includes a ring-shaped component, i.e., the support 680, and a plurality of radially extending elongated tab members, i.e., the tabs 684.

Figure 21:
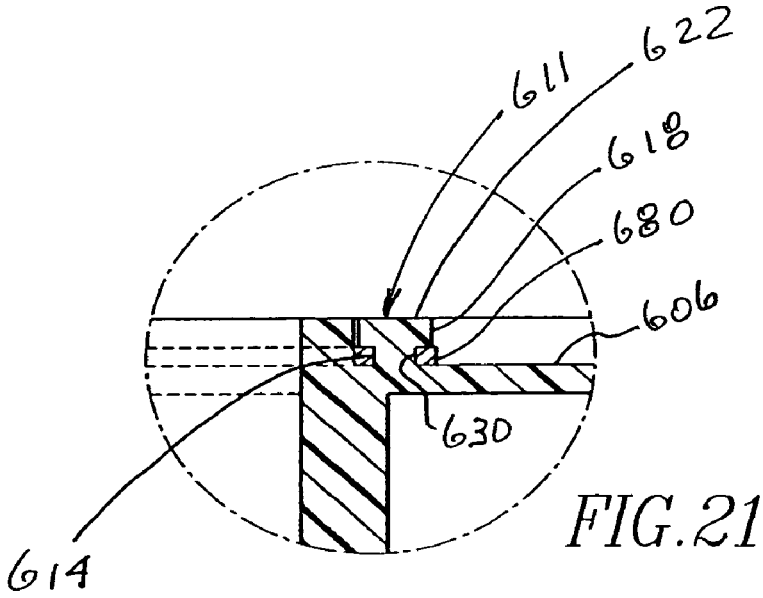
FIG. 21 is an enlarged view of a portion of FIG. 20.

The core 648 includes a generally planar and annular surface 606 that is oriented substantially perpendicular to a central axis 668 of the core 648. The core 648 additionally includes an annular projection 610 as well as a plurality of peg-shaped projections 611 extending outwardly from the surface 606. Each projection 611 includes an arm 614 extending outwardly from the surface 606 as well as a flared finger 618 extending from the arm 614 and formed at a free end 622 of the projection 611. It can be seen from FIG. 21 that the holes 630 serve as apertures that receive the arms 614 therethrough. It can further be seen from FIG. 21 that the support 680 is interposed between the fingers 618 and the surface 606. The projections 611 of the core 648 thus retain the indication member 652 on the surface 606 as well as resist relative rotation between the indication member 652 and the core 648.

Figure 25:
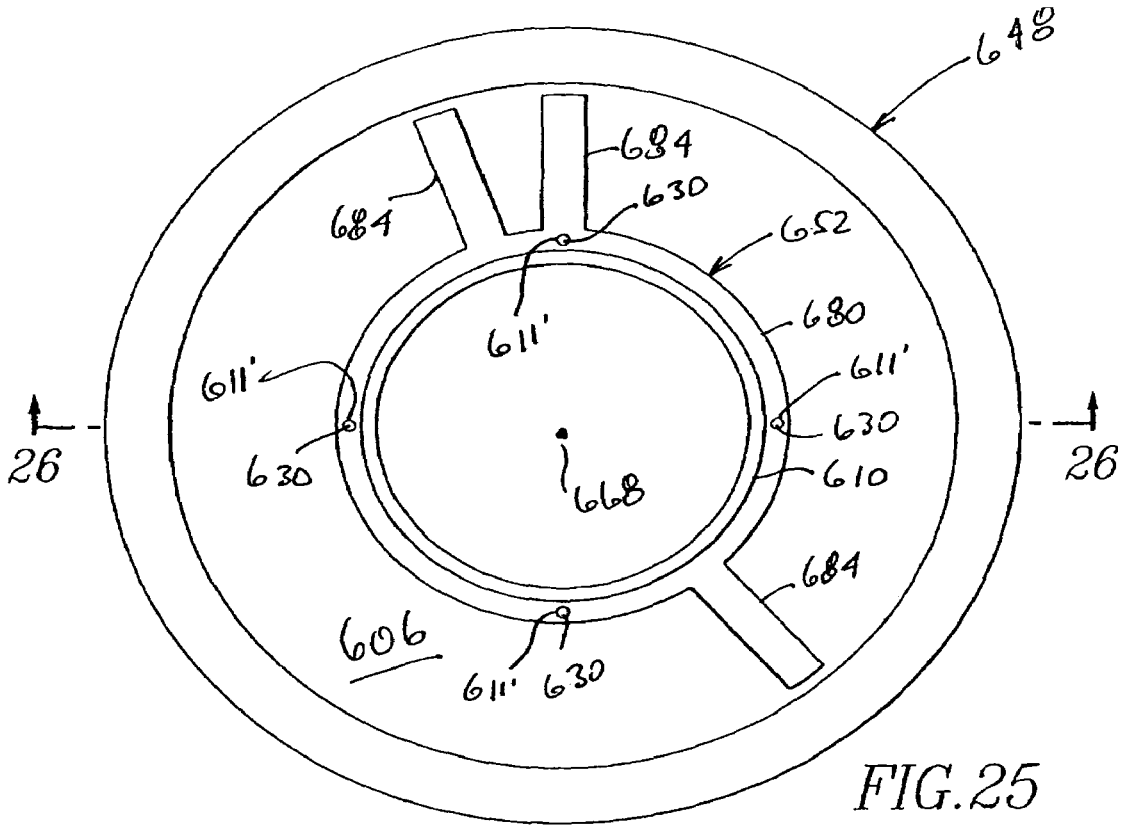
FIG. 25 is an operational top plan view during formation of the seventh embodiment according to a method.
Figure 26:
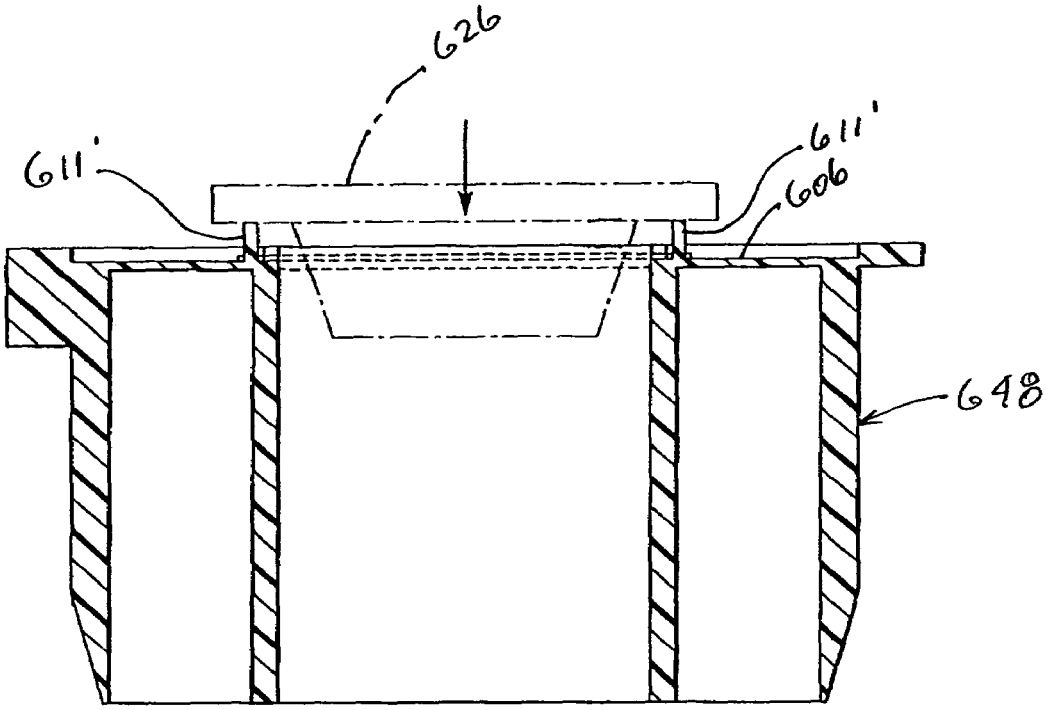
FIG. 26 is a sectional view as taken along line 26—26 of FIG. 25 and additionally depicting a tool that can be employed in forming the seventh embodiment according to the method.

A method of forming the hub 616 is depicted generally in FIGS. 25 and 26. The core 648 can be formed initially with a plurality of cylindrical projections 611'. Once the indication member 652 is received on the core 648 with the projections 611' being received through the holes 630, a tool 626 can be employed to deform the projections 611' into the projections 611. As discussed above, such a tool 626 can be a melting tool in the form of a heat stake, an ultrasonic head, or other such deforming and/or melting apparatus. It is also understood that the hub 616 can be made by employing a specially configured mold (not shown) that will mold the core 648 directly to the indication member 652.

Figure 27:
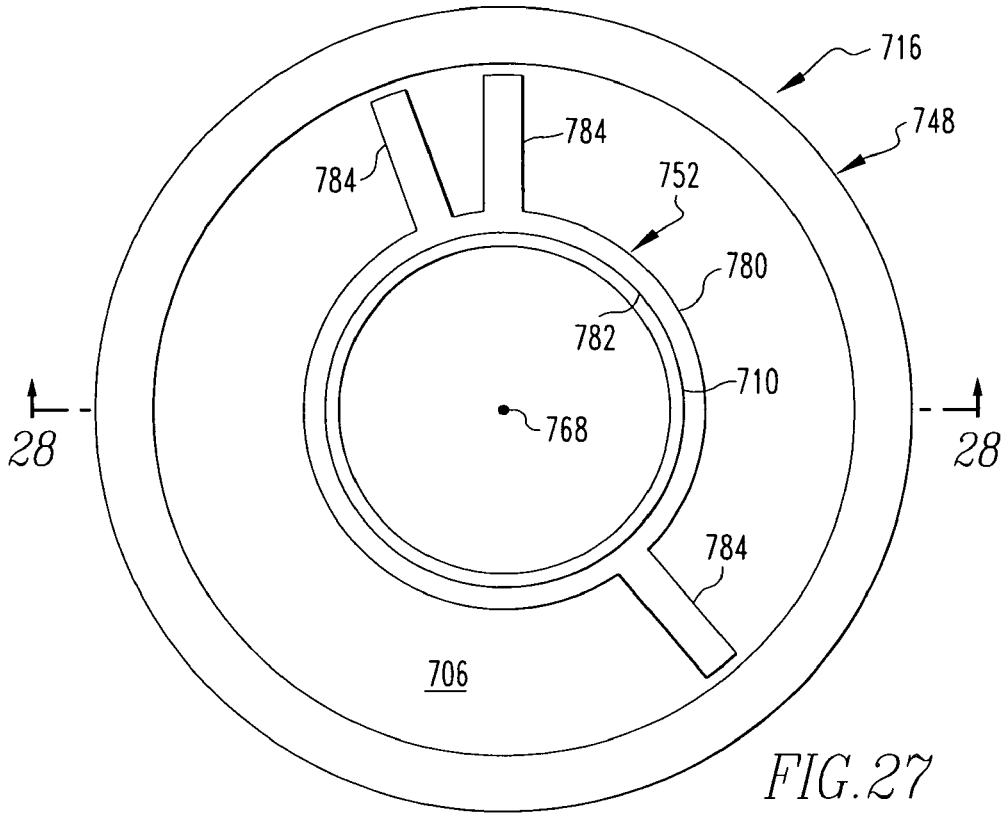
FIG. 27 is a top plan view of an improved hub in accordance with an eighth embodiment of the present invention.
Figure 28:
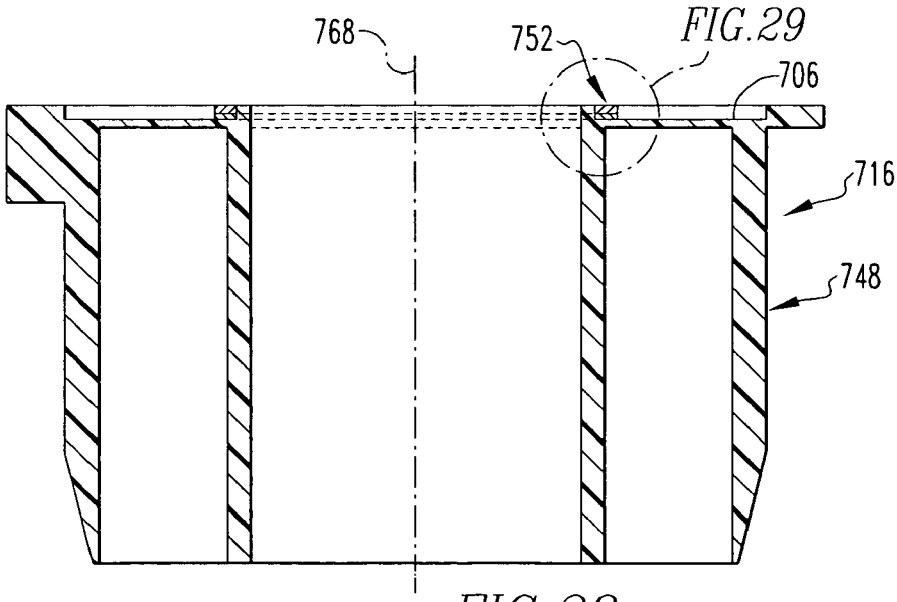
FIG. 28 is a sectional view as taken along line 28—28 of FIG. 27.
Figure 29:
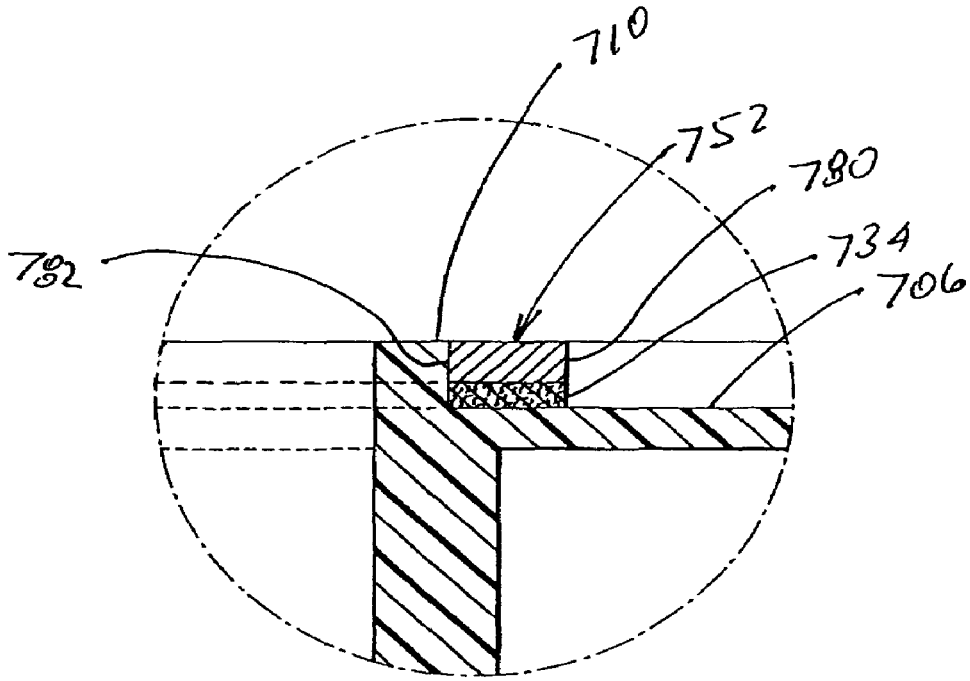
FIG. 29 is an enlarged view of a portion of FIG. 28.
Figure 30:
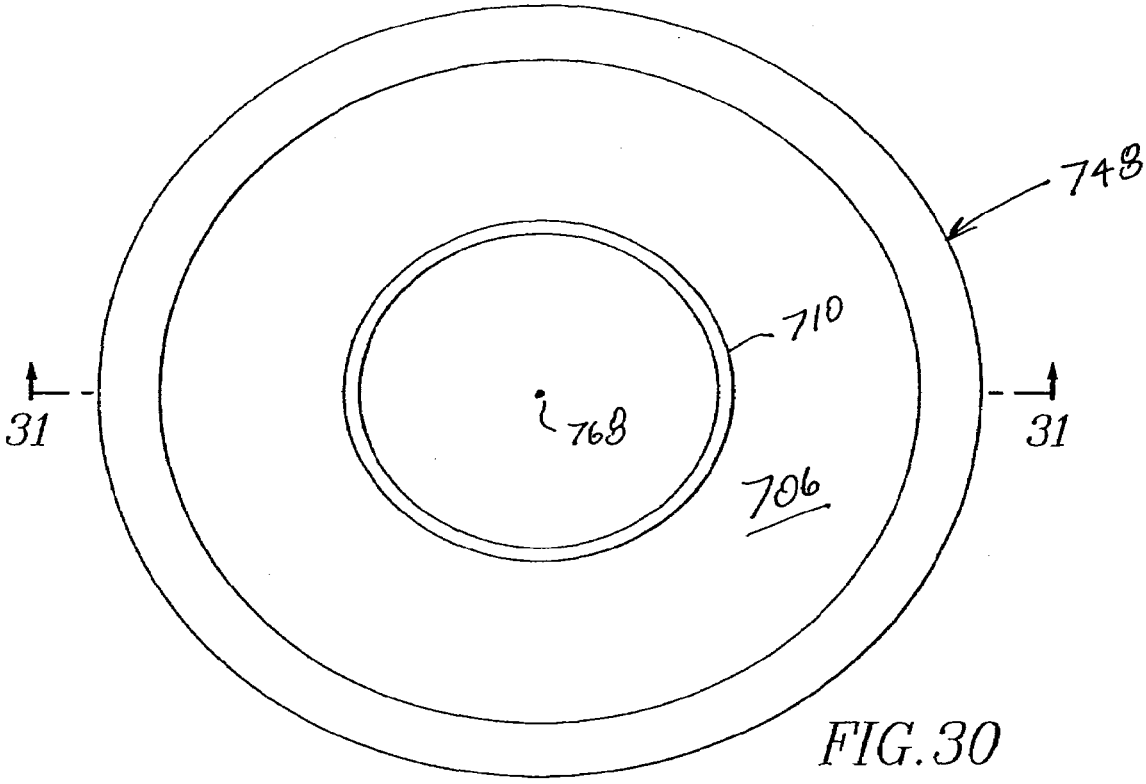
FIG. 30 is a top plan view of a core of the eighth embodiment.
Figure 31:
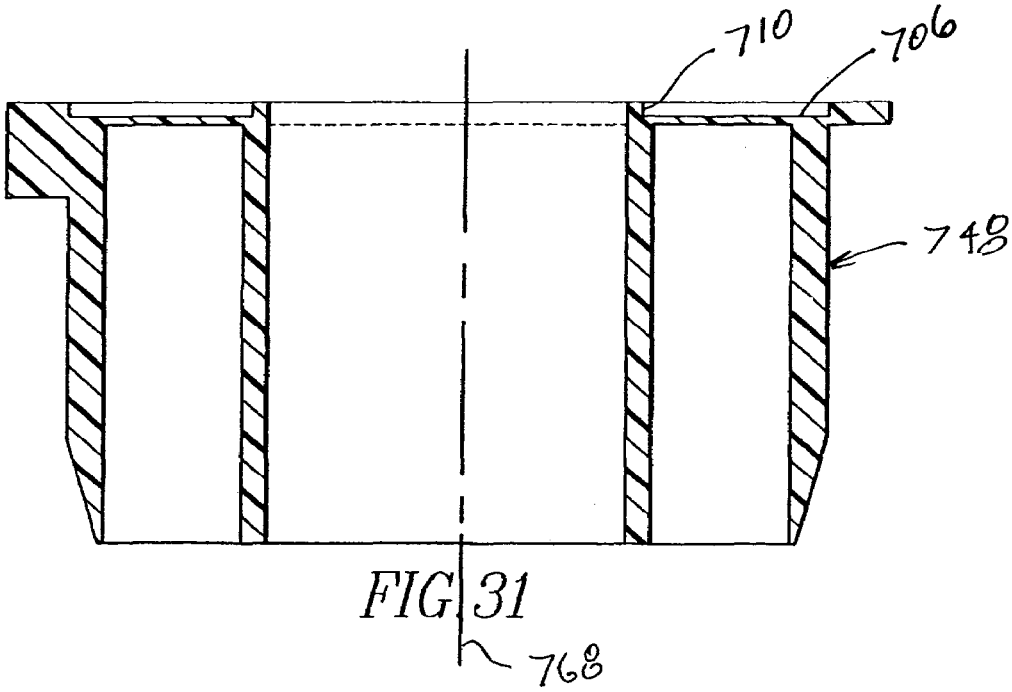
FIG. 31 is a sectional view as taken along line 31—31 of FIG. 30.

A hub 716 in accordance with an eighth embodiment of the present invention is indicated generally in FIG. 27. The hub 716 includes a core 748 (FIG. 30) and an indication member 752, with the indication member 752 including a support 780 and a plurality of tabs 784. The support 780 is generally annular in shape and defines a substantially circular central void 782. The indication member 752 thus includes a ring-shaped component, i.e., the support 780, and a plurality of radially extending elongated tab members, i.e., the tabs 784.

The core 748 includes a surface 706 that is generally planar and annular and is oriented substantially perpendicular to a central axis 768 of the core 748. The core 748 additionally includes a projection 710 extending outwardly from the surface 706 and being substantially annular in cross-section. In order to form the hub 716, the indication member 752 is mounted on the surface 706 by adhering the indication member 752 to the surface 706 with a layer of adhesive 734 interposed between the indication member 752 and the surface 706. In this regard, it can be seen that the projection 710 is received in the central void 782 of the indication member 752. The layer of adhesive 754 can be of numerous different configurations suited to the materials of the hub 716.

Figure 32:
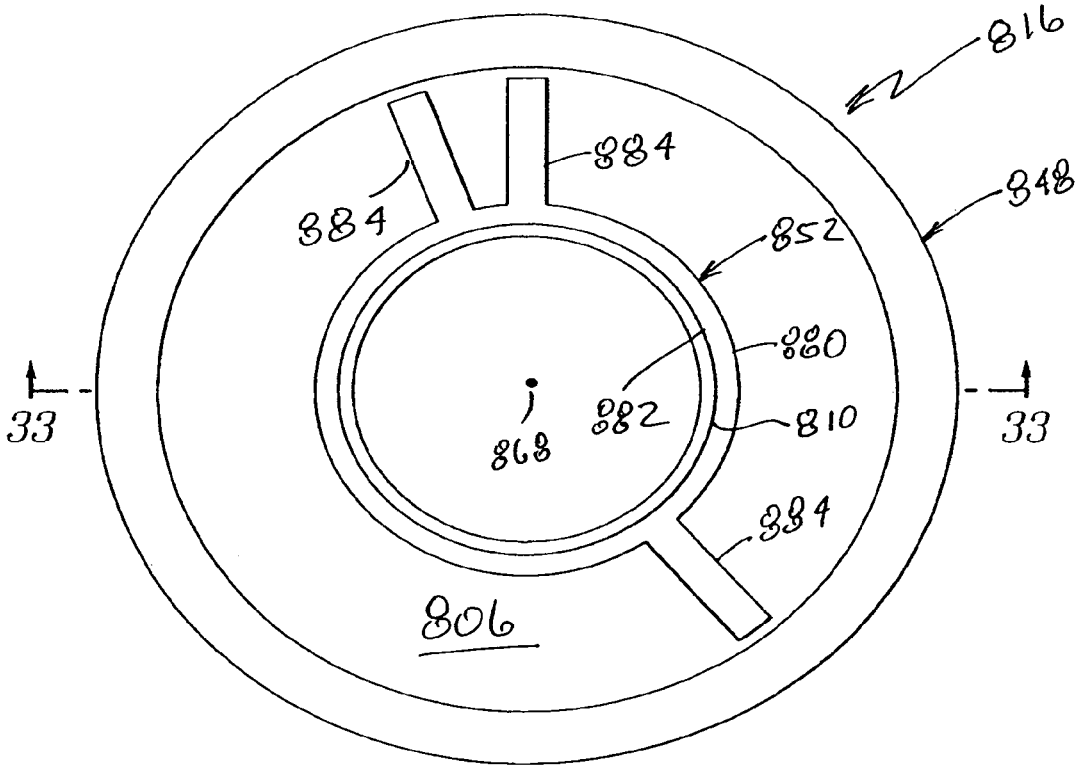
FIG. 32 is a top plan view of an improved hub in accordance with a ninth embodiment of the present invention.
Figure 33:
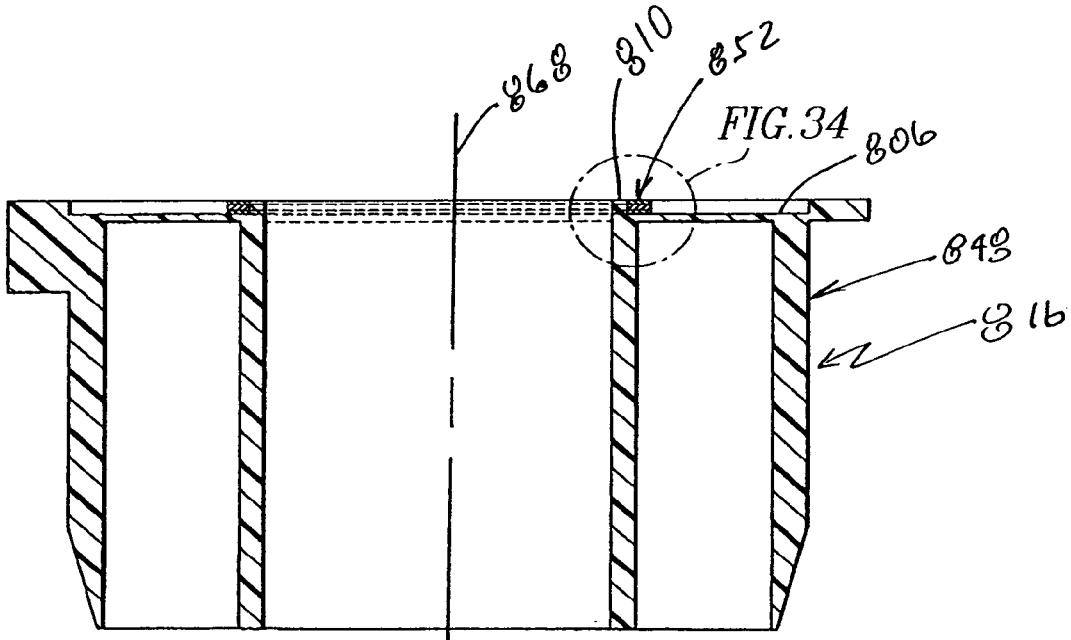
FIG. 33 is a sectional view as taken along line 33—33 of FIG. 32.

A hub 816 in accordance with a ninth embodiment of the present invention is indicated generally in FIG. 32. The hub 816 includes a core 848 and an indication member 852, with the indication member 852 including a support 880 and a plurality of tabs 884. The support 880 is generally annular in shape and thus defines a substantially circular central void 882. The indication member 852 thus includes a ring-shaped component, i.e., the support 880, and a plurality of radially extending elongated tab members, i.e., the tabs 884.

The core 848 includes a substantially planar annular surface 806 oriented substantially perpendicular to a central axis 868 of the core 848, and further includes a substantially annular projection 810 extending outwardly from the surface 806. The indication member 852 is mounted on the surface 806.

Figure 34:
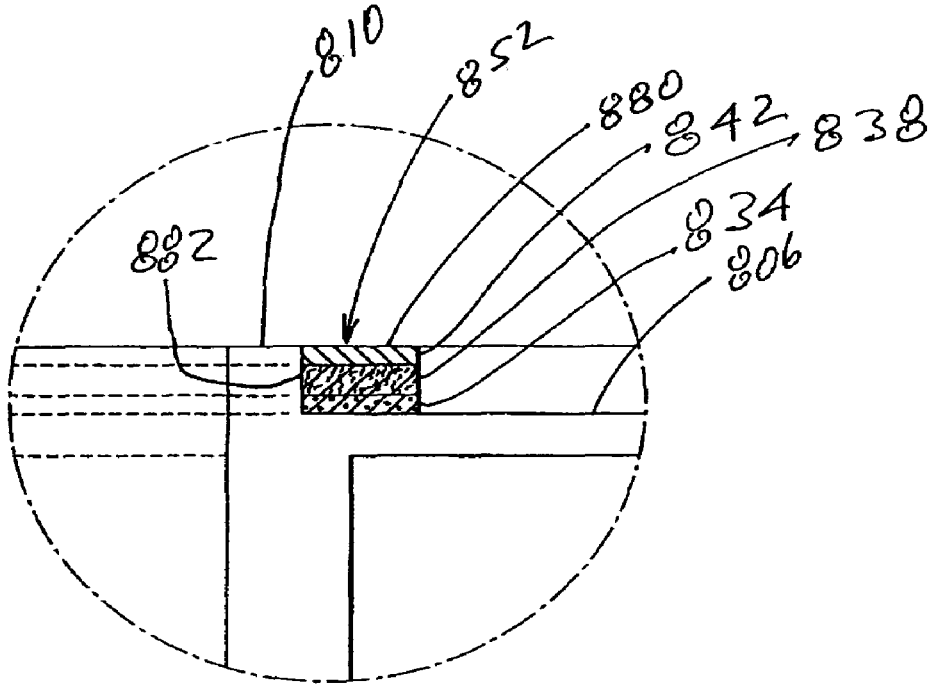
FIG. 34 is an enlarged view of a portion of FIG. 33.

As is best shown in FIG. 34, the indication member 852 includes a layer of adhesive 834, a substrate 838, and a detectable layer 842 sandwiched together. The substrate 838 may be any type of material upon which the detectable layer 842 and the layer of adhesive 834 can be disposed, such as a sheet of cardboard, a sheet of plastic, or other such materials. The detectable layer 842 may be any of a wide variety of materials that are at least partially metallic, such as a metallic foil, a metallic paint, or other such materials. The substrate 838 supports the detectable layer 842. The layer of adhesive 834 can be any type of adhesive, and may be a layer of pressure-sensitive adhesive. In such a situation, the indication member may additionally include release sheets (not shown) disposed against the layer of adhesive 834.

In order to form the hub 816, the projection 810 is received in the central void 882, and the layer of adhesive 834 is engaged with the surface 806. The indication member 852 is thereby adhered to the core 848 to form the hub 816.

Figure 35:
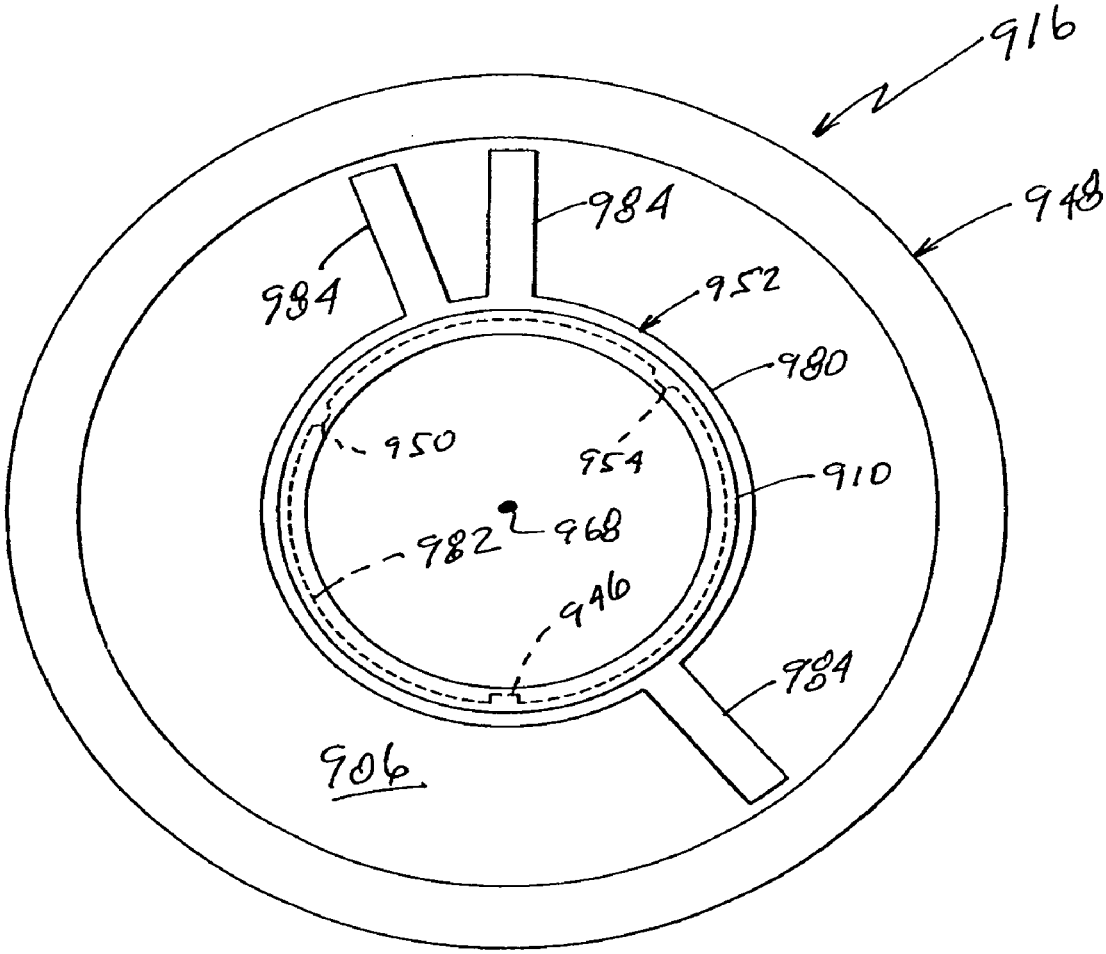
FIG. 35 is a top plan view of an improved hub in accordance with a tenth embodiment of the present invention.
Figure 36:
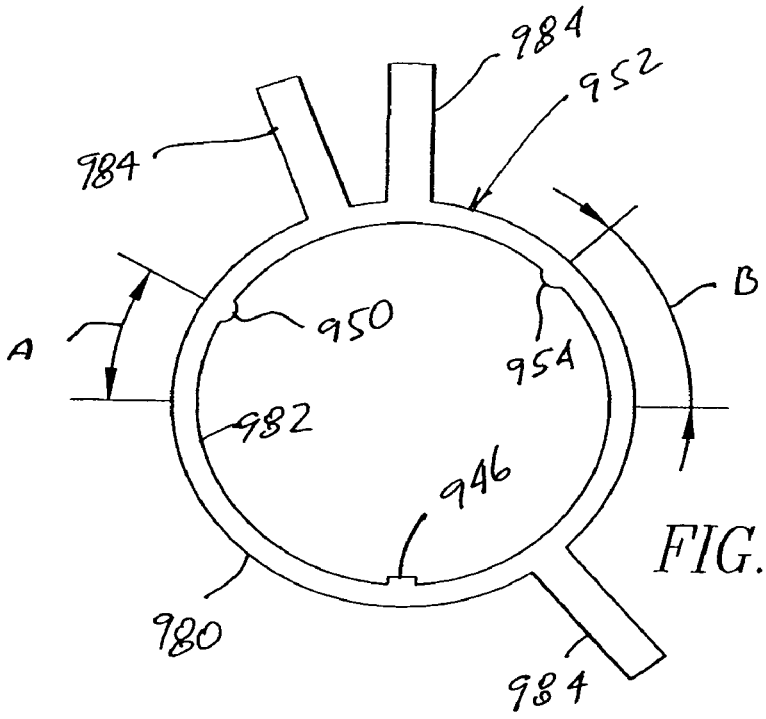
FIG. 36 is a top plan view of an indication member of the tenth embodiment.

A hub 916 in accordance with a tenth embodiment of the present invention is indicated generally in FIG. 35. The hub 916 includes a core 948 (FIG. 37) and an indication member 952 (FIG. 36). The indication member 952 includes a support 980, a plurality of tabs 984, and a plurality of alignment members 946, 950, and 954. The support 980 is generally annular and defines a central void 982 that is substantially circular except for the regions occupied by the alignment members 946, 950, and 954. The indication member 952 thus includes a ring-shaped component, i.e., the support 980, a plurality of radially extending elongated tab members, i.e., the tabs 984, which extend radially outwardly from the support 980, as well as a plurality of radially extending elongated alignment members 946, 950, and 954 that extend radially inwardly from the support 980 toward a central axis 968 of the core 948. The core 948 includes a substantially planar and annular surface 906 that is oriented substantially perpendicular to the central axis 968, and further includes a projection 910 extending outwardly from the surface 906.

As is best shown in FIGS. 35 and 36, the alignment member 946 is generally rectangular in profile and the alignment members 950 and 954 are generally arcuate in profile. The alignment members 946, 950, and 954 are engaged with the projection 910, which resists relative rotation between the indication member 952 and the core 948. It can be understood from the accompanying figures that the indication member 952 is generally flat, and that the support 980, the tabs 984, and the alignment members 946, 950, and 954 are generally coplanar. It is understood that the alignment members 946, 950, and 954 can be advantageously formed on any of the indication members of any of the hubs set forth above in order to further engage the indication member with its relative core and to resist relative rotation therebetween.

Figure 37:
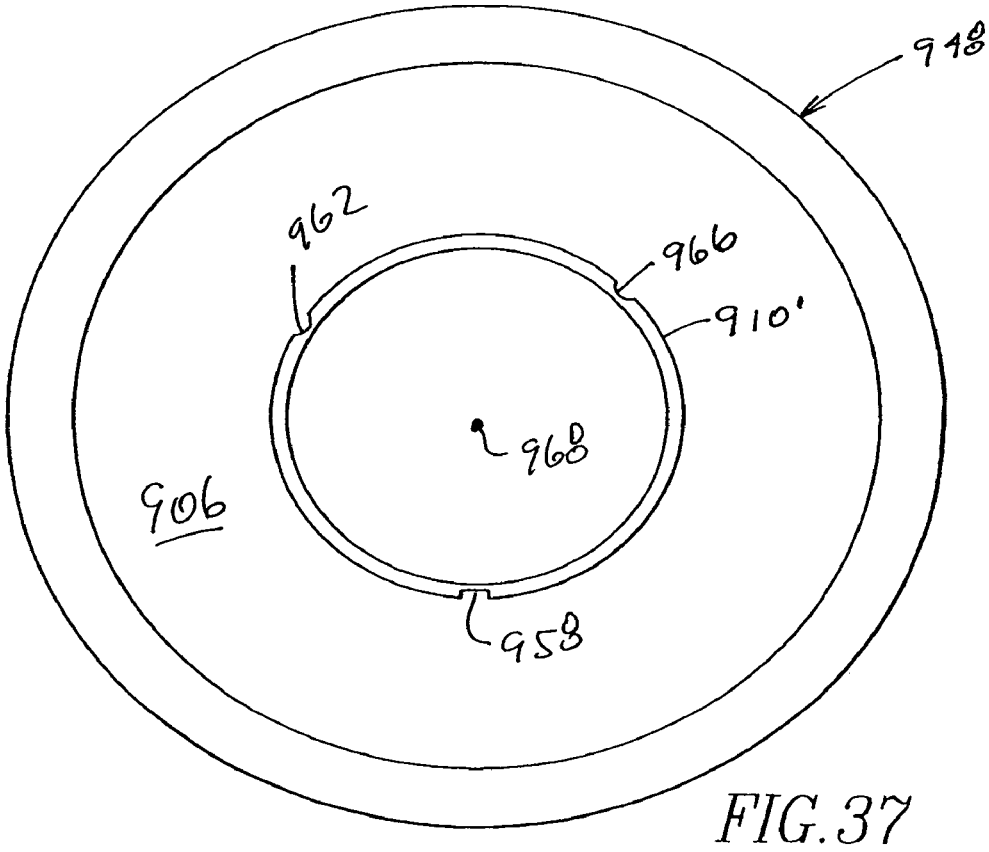
FIG. 37 is a top plan view of a core of the tenth embodiment.
Figure 38:
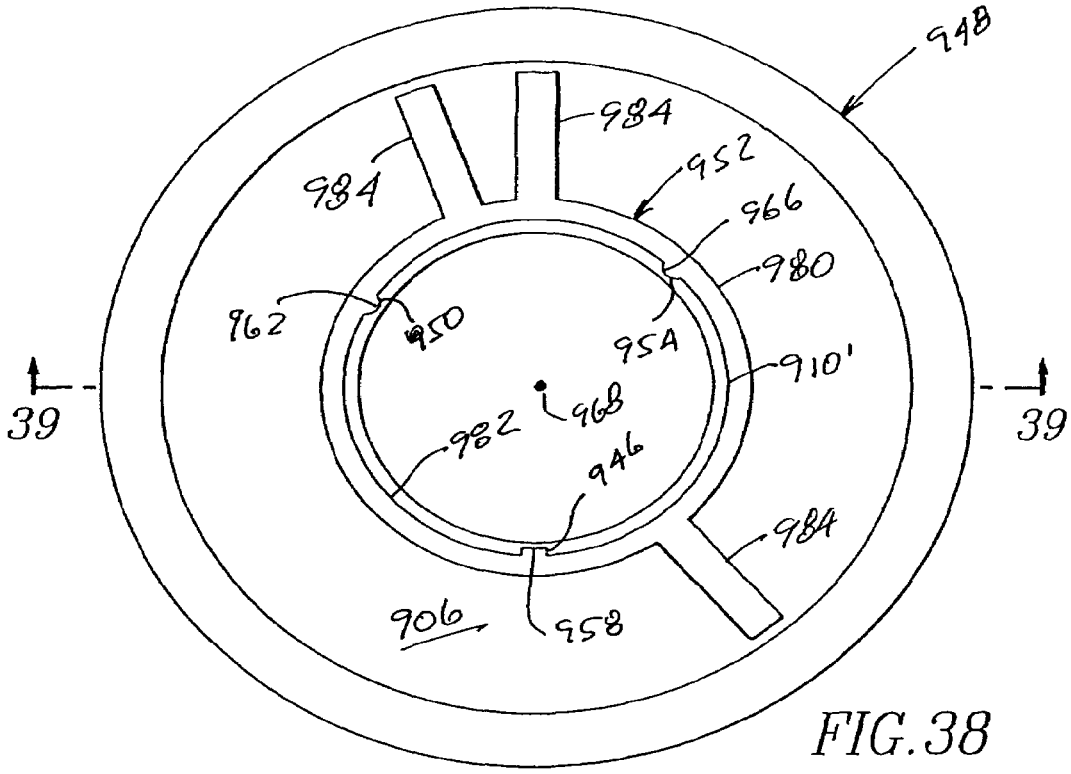
FIG. 38 is an operational top plan view during formation of the tenth embodiment according to a method.
Figure 39:
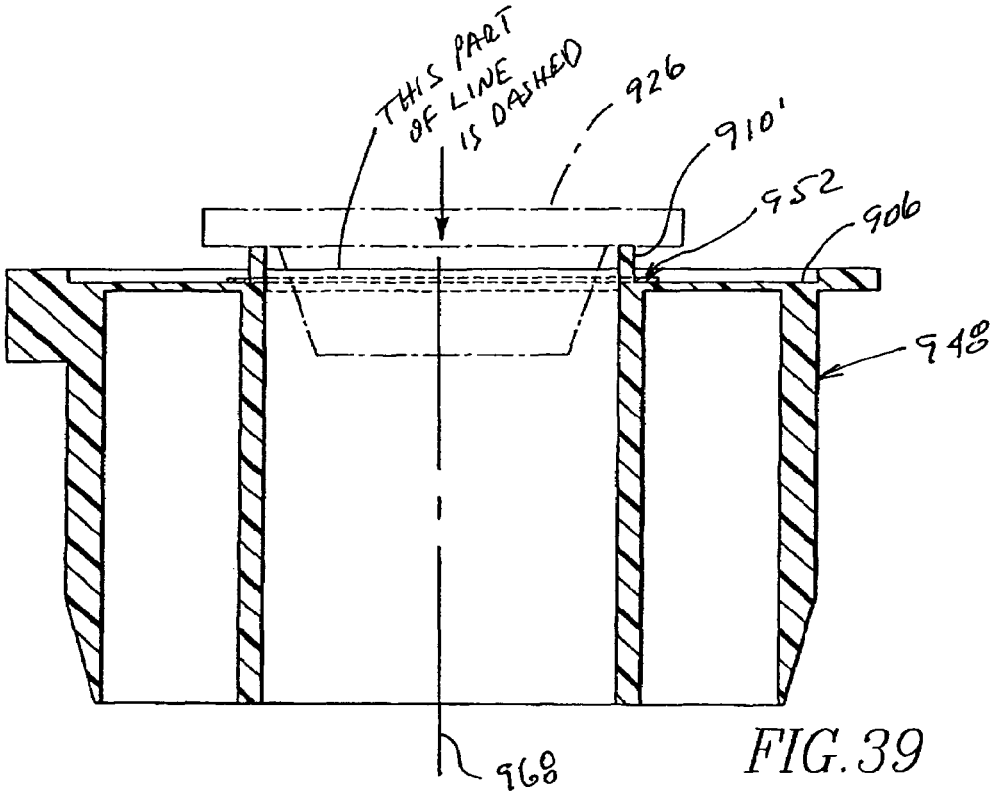
FIG. 39 is a sectional view as taken along line 39—39 of FIG. 38 and additionally depicting a tool that can be employed in forming the tenth embodiment according to the method.

One method of forming the hub 916 is depicted generally in FIGS. 37–39. Specifically, a core 948 can be formed with a projection 910' that extends outwardly from the surface 906 and that is substantially annular except for the slots 958, 962, and 966 formed therein. The slots 958, 962, and 966 are configured to receive the alignment members 946, 950, and 954, respectively, therein. The specific shapes and positions of the alignment members 946, 950, and 954 resist the indication member 952 from being received on the projection 910' in an upside-down orientation, and thus ensure that the indication member 952 is oriented correctly on the core 948 so that the tabs 984, which include a pair of home tabs and a characteristic tab, are properly oriented on the core 948 so as to be properly detected on the core 948 by the printer 8. In the exemplary indication member 952 depicted in FIG. 36, when the indication member 952 is oriented such that the alignment member 946 is at the six o'clock position, the alignment members 950 and 954 are oriented at different angles with respect to an imaginary horizontal axis as is demonstrated by the different angles A and B of FIG. 36. It is understood that the alignment members 946, 950, and 954 can be of other profiles and sizes than those described and depicted herein.

After the indication member 952 has been received on the projection 910' and is disposed against the surface 906, an appropriate tool 926 is applied to the projection 910' and deforms at least a portion of the projection 910' to form the projection 910. As indicated above, the tool 926 can be a heat stake, an ultrasonic head, or other appropriate deforming and/or melting tool.

By melting or otherwise deforming the projection 910' to form the projection 910, the projection 910 further engages the alignment members 946, 950, and 954 of the indication member 952, which secures the indication member 952 on the surface 906 and further resists relative rotation between the indication member 952 and the core 948. It is also understood that the hub 916 can be formed by positioning the indication member 952 in an appropriately configured mold (not shown) and receiving in the mold an appropriate material that forms the core 948 in such a fashion that the core 948 is molded around and extends around at least a portion of the indication member 952.

As can be seen from the foregoing, any of the hubs 16, 116, 216, 316, 416, 516, 616, 716, 816, and 916 can be employed in the detectable spool 4 for use in the printer 8. The relatively different configurations of the indication members 52 and 152, along with the difference in coloration of the material out of which the cores 48 and 148 are manufactured, each provide indicia that serve as indication means that indicate to the printer 8 and to an observer, respectively, the specific characteristics of the ribbon 28 mounted on the spool 24. The additionally different configurations of the indication members 252, 352, 452, 552, 652, 752, 852, and 952, and the correspondingly different configurations of the cores 248, 348, 448, 548, 648, 748, 848, and 948 indicate different characteristics which can be detected by the sensor 12 and that may be desirable depending upon the specific application.

It is understood that the material out of which the cores 248, 348, 448, 548, 648, 748, 848, and 948 are manufactured would be of the same color as the material out of which the core 48 is manufactured since all of the indication members 52, 252, 352, 452, 552, 652, 752, 852, and 952 have a substantially similar configuration of tabs. In this regard, it is understood that any of the indication members 252, 352, 452, 552, 652, 752, 852, and 952 can be configured to have a tab configuration similar to the indication member 152. In such a circumstance, the material out of which the cores 248, 348, 448, 548, 648, 748, 848, and 948 are made would be of the same color as the material out of which the core 148 is manufactured. It is further understood that any of the indication members 52, 152, 252, 352, 452, 552, 652, 752, 852, and 952 can have a different tab configuration than those set forth herein, and it will be similarly understood that the corresponding cores 48, 148, 248, 348, 448, 548, 648, 748, 848, and 948 will be manufactured out of a material that is correspondingly differently colored to provide visual indicia to an observer of the characteristics of the corresponding ribbon 28.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A method of forming a hub, the hub being usable with a spool, the method comprising:

forming a core with a surface;

providing an indication member including a support and at least a first tab, and a second tab;

the at least first tab being an at least first home tab and defining a home position of the indication member;

the second tab being a characteristic tab;

disposing the indication member on the surface;

retaining the indication member on the surface; and in which the step of retaining the indication member includes the step of adhering the indication member to the surface with a layer of adhesive.

2. The method as set forth in claim 1, in which the step of providing an indication member includes the step of providing an indication member having the layer of adhesive disposed thereon in the form of a layer of pressure-sensitive adhesive.

3. The method as set forth in claim 1, in which the step of forming a core includes the step of forming a core with a projection, in which the step of disposing the indication member on the surface includes the step of receiving at least a portion of the projection through an aperture formed in the indication member.

4. The method as set forth in claim 3, in which the step of retaining the indication member on the surface includes the step of deforming at least a portion of the projection so that the projection engages the indication member.

5. The method as set forth in claim 4, in which the step of deforming includes the step of forming a finger at a free end of the projection.

6. A method of forming a hub, the hub being usable with a spool, the method comprising:

forming a core with a surface and a projection;

providing an indication member including a support and at least a first tab;

disposing the indication member on the surface, while receiving at least a portion of the projection through an aperture formed in the indication member;

retaining the indication member on the surface and while deforming at least a portion of the projection so that the projection engages the indication member; and in which the step of deforming includes the steps of forming a finger at a free end of the projection and interposing at least a portion of the indication member between the finger and the surface.

7. A method of forming a hub, the hub being usable with a spool, the method comprising:

forming a core with a surface and a projection;

providing an indication member including a support and at least a first tab;

disposing the indication member on the surface and receiving at least a portion of the projection through an aperture formed in the indication member;

retaining the indication member on the surface; and in which the step of forming a core with a projection includes the step of forming a generally annular projection, in which the step of receiving at least a portion of the projection through an aperture includes the step of receiving at least a portion of the projection through a central void of the indication member, and in which the step of deforming includes the steps of melting at least a portion of the projection and forming an arm and a finger that extend around at least a portion of the indication member.

8. A method of forming a hub, the hub being usable with a spool, the method comprising:

forming a core with a surface and a projection;

providing an indication member including a support and at least a first tab;

disposing the indication member on the surface, while receiving at least a portion of the projection through an aperture formed in the indication member;

retaining the indication member on the surface and while deforming at least a portion of the projection so that the projection engages the indication member; and in which the step of deforming includes the step of ultrasonically deforming at least a portion of the projection.

9. A method of forming a hub, the hub being usable with a spool, the method comprising:

forming a core with a surface and a projection;

providing an indication member including a support and at least a first tab;

disposing the indication member on the surface, while receiving at least a portion of the projection through an aperture formed in the indication member;

retaining the indication member on the surface and while deforming at least a portion of the projection so that the projection engages the indication member; and in which the step of deforming includes the step of thermally deforming at least a portion of the projection.

10. A method of forming a hub, the hub being usable with a spool, the method comprising:

forming a core with a surface and a projection;

providing an indication member including a support and at least a first tab;

disposing the indication member on the surface and receiving at least a portion of the projection through an aperture formed in the indication member;

retaining the indication member in the surface; and in which the step of providing an indication member includes the step of providing the indication member with an alignment member, and in which the step of retaining the indication member on the surface includes the step of engaging the indication member with the projection.

11. The method as set forth in claim 10, in which the step of engaging the indication member includes the step of melting at least a portion of the projection to engage the alignment member.

12. The method as set forth in claim 10, in which the step of engaging the indication member with the projection includes the step of receiving the alignment member in a slot formed on the projection.

13. A method of forming a hub, the hub being usable with a spool, the method comprising:

forming a core with a surface;

providing an indication member including a support and at least a first tab;

disposing the indication member on the surface;

retaining the indication member on the surface; and in which the step of retaining the indication member includes the step of molding the core around at least a portion of the indication member.

14. The method as set forth in claim 13, in which the step of molding the core around at least a portion of the indication member includes the step of molding the core around at least a portion of the support.

15. A method of forming a hub, the hub being usable with a spool, the method comprising:

forming a core with a projection;

providing an indication member having an aperture formed therein;

receiving at least a portion of the projection through the aperture;

forming a finger at a free end of the projection;

deforming at least a portion of the projection to retain the indication member on the core; and in which the step of deforming includes the step of ultrasonically deforming at least a portion of the projection.

16. A method of forming a hub, the hub being usable with a spool, the method comprising:

forming a core with a projection;

providing an indication member having an aperture formed therein;

receiving at least a portion of the projection through the aperture;

forming a finger at a free end of the projection;

deforming at least a portion of the projection to retain the indication member on the core; and in which the step of deforming includes the step of thermally deforming at least a portion of the projection.

17. A method of forming a hub, the hub being usable with a spool, the method comprising:

forming a core with a projection, providing an indication member having an aperture formed therein;

receiving at least a portion of the projection through the aperture;

deforming at least a portion of the projection to retain the indication member on the core; and in which the step of forming a core with a projection includes the step of forming a generally annular projection, in which the step of receiving at least a portion of the projection through the aperture includes the step of receiving at least a portion of the projection through a central void of the indication member, and in which the step of deforming includes the steps of melting at least a portion of the projection and forming an arm and a finger that extend around at least a portion of the indication member.

18. A method of forming a hub, the hub being usable with a spool, the method comprising:

forming a core with a projection;

providing an indication member having an aperture formed therein;

receiving at least a portion of the projection through the aperture;

deforming at least a portion of be projection to retain the indication member on the core; and in which the step of providing an indication member includes the step of providing the indication member with an alignment member, and in which the step of receiving at least a portion of the projection through the aperture includes the step of engaging the indication member with the projection.

19. The method as set forth in claim 18, in which the step of receiving at least a portion of the projection through the aperture includes the step of receiving the alignment member in a slot formed on the projection.

20. The method as set forth in claim 18, in which the step of deforming includes the step of melting at least a portion of the projection to engage the alignment member.

21. A method of forming a hub, the hub being usable with a spool, the method comprising:

providing an indication member having an aperture formed therein;

molding a moldable material to the indication member;

receiving at least a portion of the material through the aperture; and forming the material into a core that retains the indication member thereon.

22. The method as set forth in claim 21, in which the step of forming the material into a core includes the step of forming a projection on the core and in which the step of receiving at least a portion of the material through the aperture includes the step of receiving at least a portion of the projection through the aperture.

23. The method as set forth in claim 22, in which the step of receiving at least a portion of the projection through the aperture includes the step of engaging the projection with the indication member.

24. The method as set forth in claim 23, in which the step of providing an indication member includes the step of providing the indication member with an alignment member, and in which the step of engaging the projection with the indication member includes the step of engaging the alignment member with the projection.

* * * * *

UNITED STATES PATENT AND TRADEMARK OFFICE

CERTIFICATE OF CORRECTION

PATENT NO. : 7,018,118 B1
APPLICATION NO. : 10/703929
DATED : March 28, 2006
INVENTOR(S) : Ernest L. Woosley et al.

It is certified that error appears in the above-identified patent and that said Letters Patent is hereby corrected as shown below:

Column 19,
Line 22, “be” should read -- the --.

Signed and Sealed this

Fourth Day of July, 2006

JON W. DUDAS
*Director of the United States Patent and Trademark Office*